US008905237B2

(12) United States Patent
Leon Alonso et al.

(10) Patent No.: US 8,905,237 B2
(45) **Date of Patent: *Dec. 9, 2014**

(54) BLISTER CARDS PROMOTING INTUITIVE DOSING

(75) Inventors: Rosa Manuela Leon Alonso, Maineville, OH (US); Kelly Lee Schmeichel, Cincinnati, OH (US); Isabelle LaFosse-Marin, Cincinnati, OH (US); Angela Jane Deutsch, West Chester, OH (US); Thomas Alfred Inglin, Loveland, OH (US); Kurt Franklin Trombley, Loveland, OH (US); Diane Danheiser Powers, Mason, OH (US); Eduardo de Abreu Mangione, Sao Paulo (BR); Craig Andrew Hawkins, Mason, OH (US); Jay Robert Morosey, Jr., Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 48 days.

This patent is subject to a terminal disclaimer.

(21) Appl. No.: 13/328,181

(22) Filed: Dec. 16, 2011

(65) Prior Publication Data

US 2012/0152796 A1 Jun. 21, 2012

Related U.S. Application Data

(63) Continuation-in-part of application No. 12/971,677, filed on Dec. 17, 2010, now Pat. No. 8,752,704.

(51) Int. Cl.

| | |
|---|---|
| ***B65D 83/04*** | (2006.01) |
| ***B65D 75/54*** | (2006.01) |
| ***G09F 23/00*** | (2006.01) |
| ***B65D 75/32*** | (2006.01) |
| ***A61J 1/03*** | (2006.01) |
| *A61J 7/04* | (2006.01) |

(52) U.S. Cl.

CPC ..... *B65D 75/327* (2013.01); *A61J 2205/30* (2013.01); *A61J 2205/20* (2013.01); *B65D 75/54* (2013.01); *G09F 23/00* (2013.01); *A61J 7/04* (2013.01); *B65D 2203/00* (2013.01); *B65D 2221/00* (2013.01); *A61J 1/035* (2013.01)

USPC ..... 206/534; 206/531; 206/532; 206/539

(58) Field of Classification Search

USPC ..... 206/531, 532, 534, 538, 539

See application file for complete search history.

(56) References Cited

U.S. PATENT DOCUMENTS 3,503,493 A * 3/1970 Nagy ..... 206/534
4,254,871 A * 3/1981 Poore ..... 206/534

(Continued)

FOREIGN PATENT DOCUMENTS

WO WO 98/22072 A1 5/1998
WO WO 2004/085266 A2 10/2004

OTHER PUBLICATIONS

PCT International Search Report dated Apr. 18, 2012—4 pages.

*Primary Examiner* — Bryon Gehman
(74) *Attorney, Agent, or Firm* — Alexandra S. Anoff

(57) ABSTRACT

A blister card with a back side and a front side opposite the back side. The front side has a plurality of blisters and each blister contains a unit dose and each unit dose contains an active. Each blister card contains from about 12 hours to about 24 hours of unit doses according to the dosage instructions. The actives can be the same or different.

13 Claims, 9 Drawing Sheets

(56) References Cited

U.S. PATENT DOCUMENTS

| | | | | |
|---|---|---|---|---|
| 4,295,567 | A | 10/1981 | Knudsen | |
| 4,473,156 | A | 9/1984 | Martin | |
| 4,553,670 | A * | 11/1985 | Collens | 206/534 |
| D370,625 | S | 6/1996 | Kelsey et al. | |
| 5,785,180 | A * | 7/1998 | Dressel et al. | 206/532 |
| 5,788,974 | A | 8/1998 | D'Amico et al. | |
| 6,270,796 | B1 | 8/2001 | Weinstein | |
| 6,375,956 | B1 * | 4/2002 | Hermelin et al. | 206/534 |
| 6,564,945 | B1 | 5/2003 | Weinstein et al. | |
| 6,651,816 | B2 * | 11/2003 | Weinstein | 206/534 |
| 7,017,748 | B2 * | 3/2006 | Weinstein | 206/534 |
| 7,063,211 | B2 | 6/2006 | Williams Hartman | |
| 7,188,728 | B2 | 3/2007 | Williams Hartman | |
| 7,243,798 | B2 | 7/2007 | Buss | |
| 7,448,496 | B2 | 11/2008 | Williams Hartman | |
| 7,665,610 | B2 | 2/2010 | Williams Hartman | |
| 2002/0045184 | A1 | 4/2002 | Chen | |
| 2002/0066691 | A1 * | 6/2002 | Varon | 206/534 |
| 2004/0064215 | A1 | 4/2004 | Greeven et al. | |
| 2005/0150806 | A1 * | 7/2005 | Lorenzato | 206/534 |
| 2008/0155941 | A1 | 7/2008 | Williams Hartman | |
| 2008/0272021 | A1 | 11/2008 | Cavazza | |
| 2009/0023001 | A1 | 1/2009 | Mizutani et al. | |
| 2009/0202635 | A1 * | 8/2009 | Scott | 424/45 |
| 2010/0154365 | A1 | 6/2010 | Williams Hartman | |

* cited by examiner

BLISTER CARDS PROMOTING INTUITIVE DOSING

CROSS REFERENCE TO RELATED APPLICATIONS

This application is a continuation-in-part of U.S. application Ser. No. 12/971,677, filed on Dec. 17, 2010 now U.S. Pat. No. 8,752,704.

TECHNICAL FIELD

The present invention is generally directed to blister cards, and more particularly, to blister cards that promote intuitive dosing.

BACKGROUND

With many treatment regimens, it is recommended to take different unit doses at different times of day and/or on certain days. These dosages may require administration at different times of the day or under different conditions, for example, on an empty stomach versus a full stomach. In addition, when the unit dose is to be administered certain times of the day, remembering which time the unit dose is to be taken can be confusing to the user. Compliance with these types of programs is therefore an issue.

Many types of packages and kits have been developed for dispensing unit doses. Such kits include those designed to dispense active ingredients on a continuous daily frequency. See, e.g., U.S. Pat. No. 5,265,728, to Allendorf et al., issued Nov. 30, 1993; EP Pub. 0 511726 A2, to Berlex Laboratories, Inc., published Nov. 4, 1992; PCT Pub. WO 99/51214, to Akzo Nobel, published Oct. 14, 1999; and U.S. Pat. No. 4,958,736, to Urheim, issued Sep. 25, 1990, which describe dispensers for administering various pharmaceuticals, including oral contraceptives, on a continuous daily basis, including regimens wherein the active ingredient is administered daily for about 21 days followed by placebo administration for about seven days. Other kits and dispensers have been developed that are designed for administering multiple doses of the same active ingredient per day, or for the concurrent or nonconcurrent administration of two or more active agents. See, e.g., U.S. Pat. No. 6,024,222, to Friberg et al., issued Feb. 15, 2000; U.S. Pat. No. 6,219,997, to Friberg et al., issued Apr. 24, 2001; U.S. Pat. Pub. 2003/0168376 A1, Taneja et al. published Sep. 11, 2003; U.S. Pat. Pub. 2003/0111479, Taneja et al., published Jun. 19, 2003; U.S. Pat. No. 6,375,956, to Hermelin et al., issued Apr. 23, 2002; PCT Pub. WO 88/02342, Astra Lakemedel Aktiebolag, published Apr. 7, 1988; U.S. Pat. No. 4,295,567, to Knudsen, issued Oct. 20, 1981; DE 29719 070, to Byk Gulden Lomberg Chemische Fabrik, published Jun. 25, 1998; U.S. Pat. No. 5,848,976, to Weinstein, issued Dec. 15, 1998; U.S. Pat. No. 6,270,796, to Weinstein, issued Aug. 7, 2001; U.S. Pat. No. 6,564,945, to Weinstein et al., issued May 20, 2003; and U.S. Pat. No. 5,788,974, to D'Amico et al., issued Aug. 4, 1998. A kit has also been disclosed for the administration of an active ingredient on a once weekly basis. See U.S. Pub. 2001/0044427, Mazel et al., published Nov. 22, 2001.

SUMMARY OF THE INVENTION

A blister card comprising: a back side; a front side opposite the back side, wherein the front side contains a plurality of blisters wherein each blister contains a unit dose, wherein the unit doses contains an active; a manufacturing indicia visible on the front side; and dosing instructions; wherein the blister card contains from about 12 hours to about 24 hours of unit doses according to the dosing instructions.

BRIEF DESCRIPTION OF THE DRAWINGS

The following detailed description of specific embodiments of the present invention can be best understood when read in conjunction with the drawings enclosed herewith.

Figure 1:
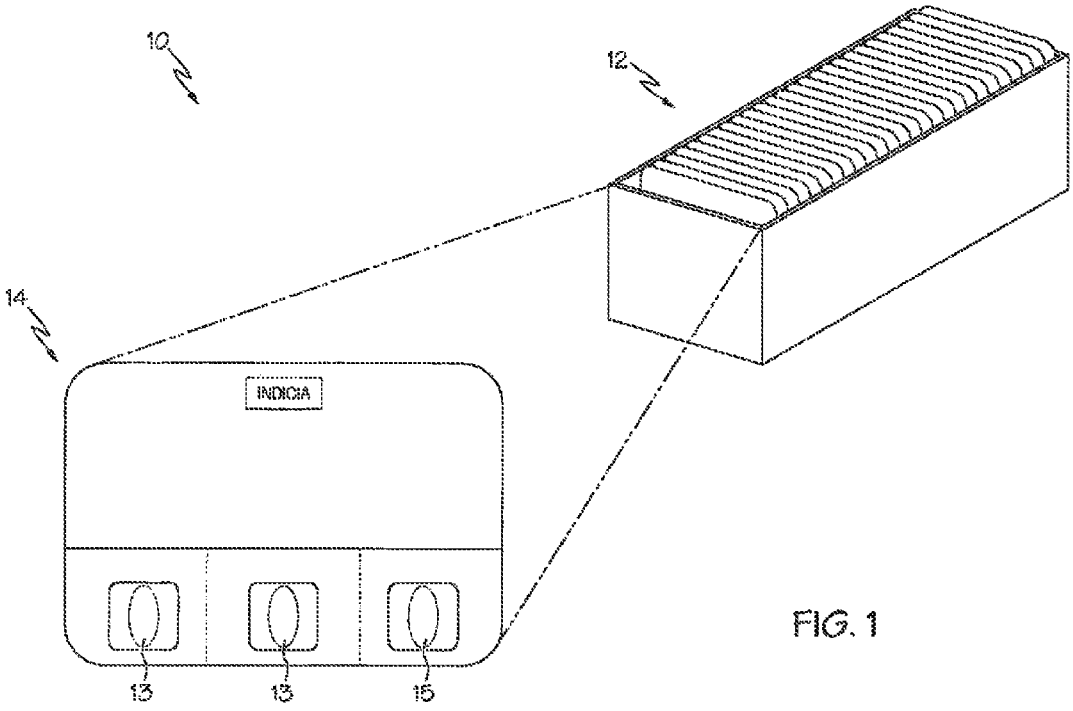
FIG. 1 illustrates an embodiment of a unit dose dispensing system.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION

The present invention relates to blister card that can provide intuitive dosing. The intuitive dosing enables users to more easily take their medication at the correct time which can ultimately allow the user to feel better throughout the day because they are taking their medication at the proper times.

The blister card can contain doses for the entire day. The entire day can include twenty-four hours of actives as indicated by the dosing instructions and can include daytime and nighttime doses. In another example, the entire day can include unit doses that are intended to be consumed during the daytime hours. In one example, the blister card contains MSR cold/flu doses. Indicia on the front of the package which can include words, numbers, or icons, easily and clearly conveys when the user should take their medication. The blister cards can contain a variety of actives including MSR cold/flu actives. The blister card can be small and portable which enables users to easily put the blister card in their pocket, purse, or briefcase and access the medication during the day. Rounded corners can make the blister card even more portable.

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

"Blister cards" are for packaging unit doses. In general, blister cards typically include a front side, which is the side that includes one or more blisters and an opposite back side through which the unit dose is removed from the blister. Blister cards may come in any variety of shapes such as rectangular, rounded such as circular, etc.

A "face" of the blister card refers to one or more visible surfaces on the front side of the blister card.

The term "blister" refers to an enclosure formed by an outer covering that is raised at the face thereby forming a cavity for housing a unit dose.

The term "regulatory information" broadly refers to information that is required to be provided with a product by a governing body, such as the U.S. Food and Drug Administration (FDA). Regulatory information for unit doses may include ingredients; warnings, if any; dosing instructions; manufacturer's or distributor's name; lot number; expiration date; opening or access instructions (e.g., for child-resistant packaging); and a statement of any tamper evident feature.

The term "contiguous," as used herein, means being in actual contact.

The term "daily" in the context of a unit dose dispensing system described herein refers to administering multiple doses of the same or different ingredients within the same day or 24 hour period. For example, a single daily blister card may include multiple doses that are all to be taken in the same 24 hour interval as indicated by the package instructions. In another example, a single daily blister card may include multiple doses that are all taken during the day as indicated by the package instructions. In one example, the doses are taken during a 8 hour time period, in another example the doses are taken during a 12 hour time period, in another example the doses are taken during a 16 hour time period, in another example the doses are taken during an 18 hour time period, and in another example the doses are taken during a 24 hour time period.

The term "unit dose" or "unit dosage" means a dosage form containing an amount of an active or nutrient suitable for administration in one single dose, according to sound medical practice.

As used herein, "active" includes all compounds and compositions that can be used to treat and/or prevent illness and/or provide overall health and wellness benefits in mammals. Non-limiting examples of particularly useful actives include non-prescription and prescription actives, vitamins, minerals, elements, plant-derived materials, energy boosting materials, probiotics, fiber, prebiotics, and combinations thereof. In one example the active is a MSR cold/flu active.

As used herein, "daytime" means a unit dosage that is generally taken during the daytime. Daytime actives can include daytime MSR cold/flu unit doses. Daytime medication can comprise stimulants. In another example, daytime unit doses are non-sedating. In one example, the daytime unit dose can comprise phenylephrine or pseudophedrine.

As used herein, "nighttime" means a unit dosage that is generally taken at or around bedtime. Nighttime medication can include nighttime MSR cold/flu medication. Nighttime unit doses can comprise sedatives. In another example, nighttime unit doses do not contain stimulants. In one example, the nighttime unit dose can comprise doxylamine succinate.

As used herein, "indicia" provides information to a potential user or user of the systems, dosage units (e.g. the active contained therein) and blister cards. The indicia can comprise many forms and present the information in many ways and in many types of media. Non-limiting examples of types of indicia include alpha-numeric indicia, pictures, drawings, illustrations, photographs, computer-produced images, colors, sounds, textures, shapes, symbols, letters, numbers, and combinations thereof.

Referring to FIG. 1, one exemplary embodiment of a unit dose dispensing system 10 includes a container 12 (e.g., a box) that houses multiple blister cards 14 therein. As one example, each blister card 14 may include multiple unit doses 13 and 15 that are all to be consumed on a daily basis (i.e., within a 24 hour period). Thus, the blister cards 14 may be referred to as daily blister cards. A user utilizing the unit dose dispensing system 10 may remove a blister card 14 from the container 12 on a daily basis and carry the blister card 14 with him or her for self-administering the unit doses associated with the blister card 14.

In some examples, unit dose 13 may be different than unit dose 15. For example, unit dose 13 may contain or have a different active, different loading (e.g., different amounts of an active), a different color, a different marking, a different size and/or a different shape than unit dose 15. The unit doses 13, for example, may be administered during the day when sedation is not desired. The unit dose 15, for example, may be administered during the night when stimulation is not desired. The unit dose 13 may contain a non-sedating antihistamine and/or decongestant, but not a sedating antihistamine. The unit dose 15 may contain a sedating or non-sedating antihistamine, but not a stimulating nasal decongestant. In another example, unit dose 13 and unit dose 15 both can comprise more than one active and at least one active is different. Of course, other active ingredients are possible, some of which are set forth below.

In another example, unit dose 13 and unit dose 15 can contain the same active and the unit doses are intended to be consumed during the day. For example, the blister card can contain three unit doses, one can be taken in the morning, another at mid-day, and another in the afternoon. The user can then take a different product, such as a liquid medication, if so desired, at night.

Figure 2:
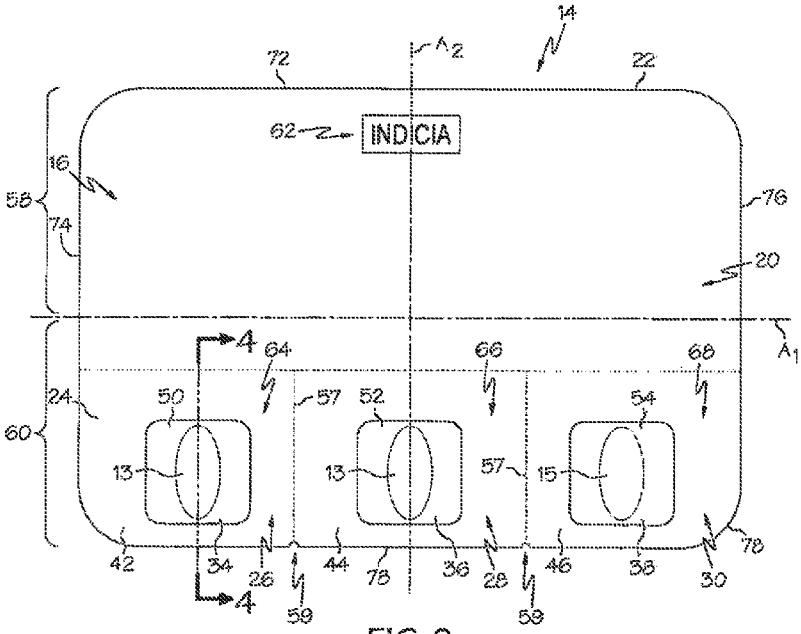
FIG. 2 illustrates a front view of an embodiment of a blister card for use with the unit dose dispensing system of FIG. 1.
Figure 3:
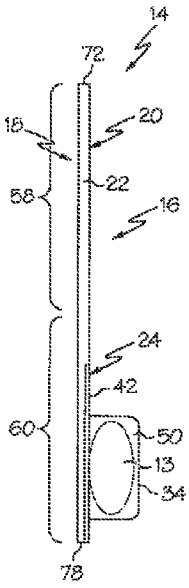
FIG. 3 is a side view of the blister card of FIG. 2.

The blister cards 14 may include information that aids a user in understanding how (e.g., when) to take the unit doses 13 and 15 carried by the blister cards 14. Referring now to FIGS. 2 and 3 showing the blister card 14 in isolation, the blister card 14 generally includes a front side 16 and a back side 18 opposite the front side 16. Referring particularly to FIG. 2, the front side 16 includes a face 20 that is visible to the user having an outer periphery 22. A total planar area of the front side 16 is defined by the outer periphery 22 (e.g., width of the front side multiplied by the height of the front side for a rectangular-shaped blister card). A blister sheet 24 extends over at least a portion of the face 20. In the illustrated embodiment, the blister sheet 24 extends over only a portion of the face 20, however in other embodiments, the blister sheet 24 may extend over a greater portion of the face 20 such as all of the face 20. The blister sheet 24 includes multiple, visible blister regions 26, 28 and 30, each including a blister 34, 36 and 38 extending outwardly at the face 20 and a shoulder region 42, 44 and 46 surrounding its respective blister 34, 36 and 38. The shoulder regions 42, 44 and 46 may be used to attach or bond the blister sheet 24 to the face 20. The blisters 34, 36 and 38 each form a cavity 50, 52 and 54 into which one or more unit dose (e.g., in tablet form, capsule form, liquid form) can be held.

In some embodiments, each blister region 26, 28 and 30 may include a perforated boundary 57 (or other line of weakness) that allows for removal of the particular blister region 26, 28 and 30 from the blister card 14. Notches 59 may be provided at corners of the blister regions 26, 28 and 30, which may serve to round corners such that a relatively square, sharp corner is not provided, e.g., when tearing a blister region 26, 28 and 30 from the blister card 14. The notches 59 may also serve as a visual separation between the different blister regions 26, 28 and 30.

The front side 16 includes two or more primary indicia areas 58 and 60. In the embodiment of FIG. 2, the primary indicia area 58 may be a primary manufacturer indicia area and the primary indicia area 60 may be a primary unit dose indicia area. The primary manufacturer area 58 may extend continuously over the face 20 of the front side 16, may be without any blisters and unit doses and may include at least one manufacturer indicator 62, such as a logo, image, manufacturer name, etc. to provide the user an indicator of the manufacturer or origin of the blister card 14. Generally, the term "primary manufacturer area" refers to the area of the face 20 encompassing the at least one manufacturer indicator 62 and not including a blister and unit dose.

The primary unit dose indicia area 60 may correspond to the area occupied on the face 20 of the front side 16 by the visible blister regions 26, 28 and 30 of the blister sheet 24. In some embodiments, the primary unit dose indicia area 60 includes two or more unit dose instructional subareas 64, 66 and 68. Each unit dose instructional subarea 64, 66 and 68 may be visible to the user and include an instructional indicator (not shown in FIG. 2) that indicates a period of day that the unit dose associated with the unit dose instructional subarea 64, 66 and 68 is to be consumed.

In the embodiment of FIG. 2, the blister card 14 has a horizontal or long axis $A_1$ extending along a width of the blister card 14 and a vertical or short axis $A_2$ extending along a height of the blister card 14. Horizontal and vertical is with reference to when the face 20 is in a vertical orientation with the manufacturer indicator 62 in the illustrated upright orientation. As can be seen, the primary manufacturer indicia area 58 extends continuously from the primary unit dose area 60 along the height (i.e., in the direction of the vertical axis $A_2$) to a top edge 72 of the outer periphery 22. The primary manufacturer indicia area 58 also extends continuously along the width (i.e., in the direction of the horizontal axis $A_1$) between side edges 74 and 76 of the outer periphery 22.

The primary unit dose indicia area 60 extends continuously from the primary manufacturer indicia area 58 along the height (i.e., in the direction of the vertical axis $A_2$) to a bottom edge 78 of the outer periphery 22. The primary unit dose indicia area 60 also extends continuously along the width (i.e., in the direction of the horizontal axis $A_1$) between side edges 74 and 76 of the outer periphery 22.

Figure 4:
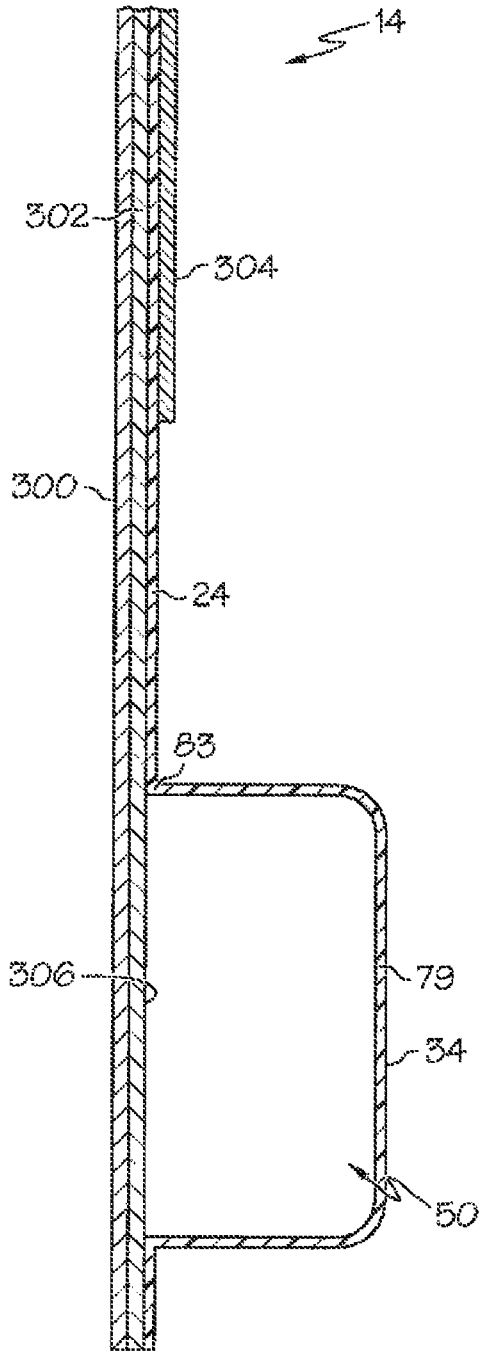
FIG. 4 is a section view of a blister region along line 4-4 of FIG. 2.

Referring to FIG. 4, a sectional view of the blister card 14 including the blister 34 is shown without unit dose 13. In the illustrated embodiment, the blister card 14 includes a backing layer 300, a rupturable layer 302, the blister sheet 24 and a covering layer 304. In some embodiments, the backing layer 300 and covering layer 304 may be formed of the same sheet of material that is folded at the top edge 72 (FIG. 3) of the blister card 14 such that the blister sheet 24 and the rupturable layer 302 are at least partially sandwiched therebetween. In other embodiments the rupturable layer 302 and the blister sheet 24 may not be sandwiched between the backing layer 300 and the covering layer 304.

Figure 5:
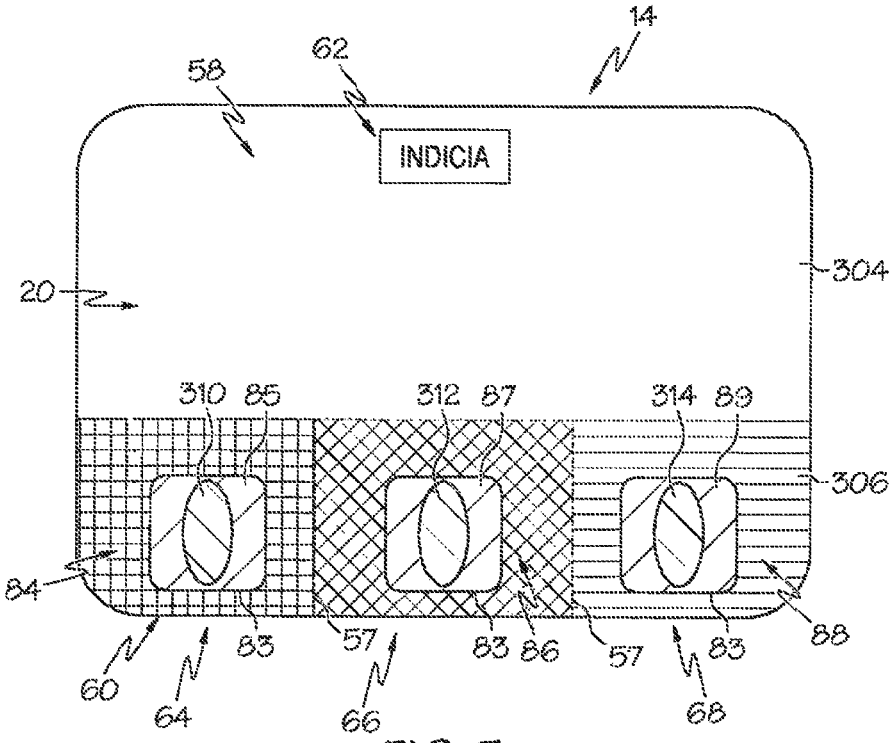
FIG. 5 is a front view of the blister card of FIG. 2 with the blister sheet removed.

The blister 34 includes an outer blister wall 79 that defines the cavity 50 between the outer blister wall 79 and a blister backing surface 306 that is formed by the rupturable layer 302. A shoulder 83 provides a boundary where the outer blister wall 79 lifts from and is unbonded to the blister backing surface 306. As seen in FIG. 5, a projected cavity area 85 is bounded by the shoulder (represented by line 83) at the locations where the shoulder lifts from the blister backing surface 306. The projected cavity area is the footprint of the cavity 50 on the blister backing surface 306 of the blister card 14.

Referring to FIG. 5, the blister card 14 is illustrated with the blister sheet 24 removed to illustrate the face 20. The face 20 includes the primary manufacturer indicia area 58 which, in this embodiment, may be formed by the covering layer 304 and the primary unit dose indicia area 60 that is contiguous with the primary manufacturer indicia area 58. The manufacturer indicator 62 is located within the primary manufacturer indicia area 58. In some embodiments, information or indicia other than the manufacturer indicator 62 may also be located in the manufacturer indicia area 58.

The face 20 further includes the primary unit dose indicia area 60. The primary unit dose indicia area 60 is subdivided into multiple unit dose instructional subareas 64, 66 and 68. In the embodiment of FIG. 5, the unit dose instructional subareas 64, 66 and 68 each correspond to (e.g., include about the same boundary, location and dimensions as) a respective one of the visible blister regions 26, 28 and 30 (FIG. 2) where adjacent visible blister regions 26, 28 and 30 are separated by a line of weakness or tear line 57 (e.g., a perforated or score line).

Projected cavity areas 85, 87 and 89 are located within the unit dose instructional subareas 64, 66 and 68. In some embodiments, no more than about 45 percent of the total planar area bounded by the outer periphery 22 is covered by the projected cavity areas 85, 87 and 89. In some embodiments, no more than about 40 percent of the total planar area bounded by the outer periphery 22 is covered by the projected cavity areas 85, 87 and 89, such as about 35 percent or less, such as about 30 percent or less, such as about 25 percent or less, such as about 20 percent or less, such as about 18 percent or less, such as about 10 percent or less. In some embodiments, the total planar area bounded by the outer periphery 22 may be no greater than about 120 $cm^2$, such as no greater than about 100 $cm^2$, such as no greater than about 80 $cm^2$, such as no greater than about 70 $cm^2$, such as no greater than about 61 $cm^2$, such as no greater than about 50 $cm^2$.

In some embodiments, for the blister card 14 having a substantially rectangular shaped outer periphery, such as seen in FIG. 2, no more than about 36 percent of the total planar area bounded by the outer periphery 22 is covered by the projected cavity areas 85, 87 and 89. For example, in some embodiments of a substantially rectangular blister card 14, no more than about 27 percent of the total planar area bounded by the outer periphery 22 is covered by the projected cavity areas 85, 87 and 89, such as no more than about 18 percent. For other outer periphery shapes, as will be discussed below, these percentages may be different.

In some embodiment, the projected cavity areas 85, 87 and 89 may only include (i.e., be bounded by or limited only to) a percentage of a projected dose footprint area 310, 312 and 314. The "projected dose footprint area" is the footprint of the unit doses 13 and 15 projected onto the blister backing surface 306. In some embodiments, each projected cavity area 85, 87 and 89 may be no greater than between about 100 percent and about 250 percent of their associated projected dose footprint area 310, 312 and 314, such as between about 100 percent and about 150 percent. In these embodiments, the total projected cavity area (i.e., the sum of the individual projected cavity areas) is only a percentage (e.g., between about 100 percent and about 150 percent) of the total projected dose footprint area (i.e., the sum of the total projected dose footprints). For purposes of these embodiments, as an example for an oversized blister having a total projected cavity area much greater than a total projected dose footprint area, the total projected cavity area includes only that area within about 100 percent and about 250 percent, such as within about 100 percent and about 150 percent of the total projected dose footprint area.

Figure 9:
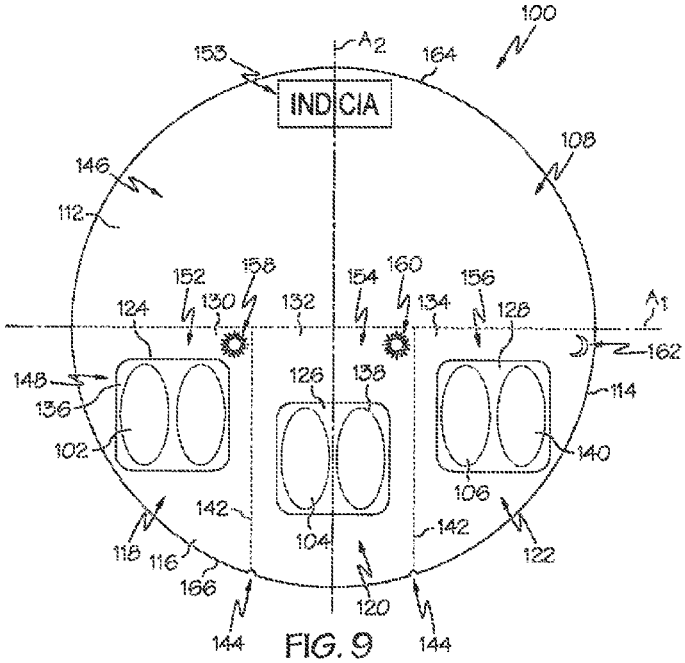
FIG. 9 is another embodiment of a blister card.

In some embodiments, a single blister may include only one unit dose as shown by FIG. 2 or multiple unit doses as shown by FIG. 9. In embodiments including only a single unit dose in a blister, the projected cavity area may be no greater than between about 100 percent and about 150 percent of its associated projected dose footprint area. In embodiments including multiple unit doses in a blister, the projected cavity area may be no greater than between about 150 percent and about 250 percent of its associated projected dose footprint area.

At least some or all of the unit dose instructional subareas 64, 66 and 68 include an instructional indicator 84, 86 and 88 that is visible through the blister sheet 24 (e.g., the blister sheet may be formed of a transparent or translucent material). In the example of FIG. 5, each unit dose instructional subarea 64, 66 and 68 is a different color as the instructional indicators 84, 86 and 88. In some embodiments, the colors of the unit dose instructional subareas 64, 66 and 68 may be selected to provide a logical timing sequence corresponding to different time periods of a day. For example, the unit dose instructional subarea 64 may be bright yellow to indicate a morning time period, the unit dose instructional subarea 66 may be a yellow-orange to indicate an afternoon or evening time period and the unit dose instructional subarea 68 may be blue to indicate a night time period.

In one example, the unit doses 13 and 15 (FIG. 1) may be different colors to provide another instructional indicator for each unit dose instructional subarea 64, 66 and 68. For example, unit doses 13 may each be yellow and/or yellow-orange to indicate a daytime period and unit dose 15 may be blue to indicate a nighttime period. Other color combinations are possible.

Each unit dose instructional subarea 64, 66 and 68 is contiguous with an adjacent unit dose instructional subarea 64, 66 and 68. In some embodiments, at least some or all of the unit dose instructional subareas 64, 66 and 68 has a clear, defined boundary between the adjacent unit dose instructional subareas 64, 66 and 68. In these embodiments where a unit dose instructional subarea 64, 66 and 68 is marked by a defined boundary or abrupt change in color, the unit dose instructional subareas 64, 66 and 68 may be referred to as a discrete (i.e., distinct) unit dose instructional subarea 64, 66 and 68.

Figure 6:
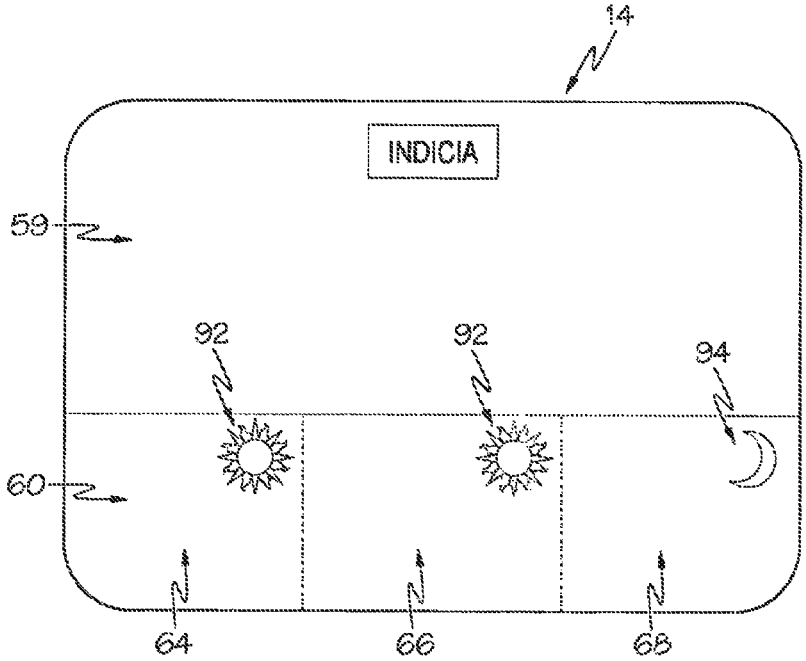
FIG. 6 is another front view of the blister card of FIG. 2 with the blister sheet removed.

Referring to FIG. 6, in addition to color, the unit dose instructional subareas 64, 66 and 68 may include other instructional indicators 92 and 94. For example, instructional indicator 92 may be an image of the sun indicating a daytime period and instructional indicator 94 may be an image of the moon indicating a nighttime period. The instructional indicator 92 of the sun may be located completely or at least partially within each of the unit dose instructional subareas 64, 66 and 68, while the instructional indicator 94 may be located completely or at least partially within the unit dose instructional subarea 68. The instructional indicators 92 and 94 can also be viewed through the blister sheet 24 and, in some embodiments, through the blisters 34, 36 and 38.

In addition to images of the sun and moon, other instructional indicators may include text, such as "Morning," "Mid-Day" "Afternoon," "Evening," and "Night" or other language equivalent. In some examples, instructional indicators may include other image types such as a clock. In one example, times of day may also be associated with each unit dose instructional subarea 64, 66 and 68.

In some embodiments, the instructional indicators may be arranged in a sequentially directional dosing arrangement. The term "sequentially directional dosing arrangement" refers to the unit doses being arranged on the blister card directionally (e.g., left-to-right) in a successive order according to the time of day to be consumed. For example, the sequentially directional dosing arrangement may provide a left-to-right and counter-clockwise timing arrangement where left most blisters are accessed first to remove the unit doses. In another example, the sequentially directional dosing arrangement may provide a right-to-left and clockwise timing arrangement where right most blisters are accessed first to remove the unit doses. Other arrangements may be employed such as top-to-bottom and bottom-to-top sequentially directional dosing arrangements.

Figure 7:
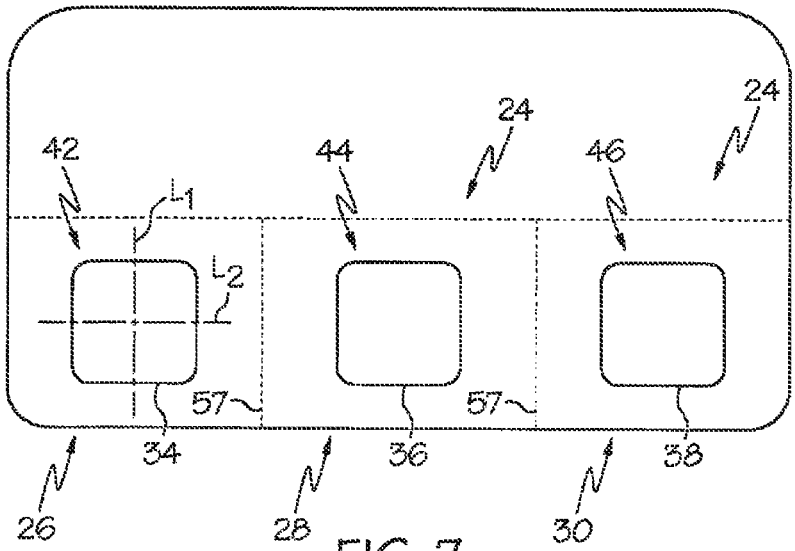
FIG. 7 is a front view of an embodiment of a blister sheet.

Referring now to FIG. 7, the blister sheet 24 is illustrated in isolation. The blister sheet 24 includes the blister regions 26, 28 and 30 that are separated by the tear lines 57. Each blister region 26, 28 and 30 includes one of the blisters 34, 36 and 38 and one of the shoulder regions 42, 44 and 46. The blister sheet 24 may be bonded directly to the rupturable layer 302 (FIG. 4) within the shoulder region regions 42, 44 and 46. In some embodiments, each blister 34, 36, 38 may have a vertical axis $L_1$ and a horizontal axis $L_2$, e.g., for holding capsule-shaped (oval) tablets. The vertical axes $L_1$ of the blisters 34, 36 and 38 may be aligned substantially parallel to the vertical axis $A_2$ of the blister card 14, while the horizontal axes $L_2$ may be aligned substantially parallel to the horizontal axis $A_1$ of the blister card 14. In other embodiments, the vertical axes $L_1$ of the blisters 34, 36 and 38 may be offset angularly from both the horizontal and vertical axes $A_1$ and $A_2$ of the blister card 14.

Figure 8:
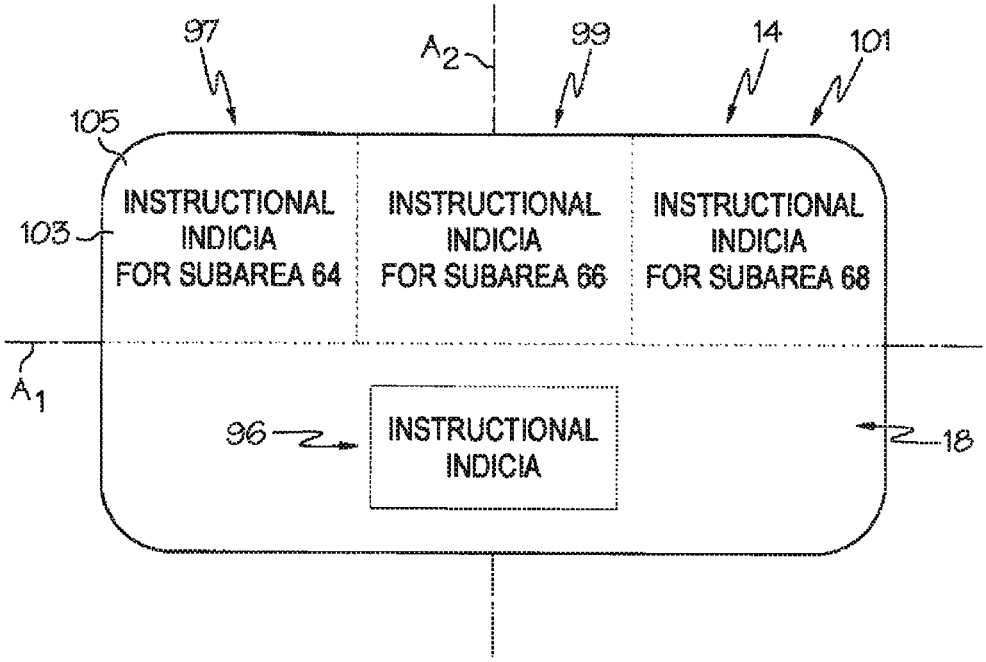
FIG. 8 is a back view of the blister card of FIG. 2.

Referring to FIG. 8, the back side 18 of the blister card 14 is illustrated where the blister card 14 is flipped about its horizontal axis $A_1$. Instructional indicia 96 is printed and viewable on the back side of the blister card 14. The instructional indicia 96 may include regulatory information, dosage details, ingredients, manufacturer information, warnings, etc.

The instructional indicia 96 including the regulatory information may pertain to any one or all of the unit doses within the unit dose instructional subareas 64, 66 and 68 (FIG. 5). The instructional indicia 96 including any regulatory information may be located such that the regulatory information is not damaged when a unit dose is removed from at least one of the at least three blisters through the back side 18.

Instructional indicia 97, 99 and 101 may also be present on the back side of each of the unit dose instructional subareas 64, 66 and 68. In some embodiments, the instructional indicia 97, 99 and 101 may be located on the back side 18 to maintain a spatial orientation with the unit dose instructional subareas 64, 66 and 68 on the front side 16 such that, for example, the instructional indicia 97 is associated with the unit dose instructional subarea 64, the instructional indicia 99 is associated with the unit dose instructional subarea 66 and the instructional indicia 101 is associated with the unit dose instructional subarea 68. Maintaining such a spatial orientation can allow the instructional indicia 97, 99 and 101 associated with each unit dose 13 and 15 to be carried away with its associated unit dose instructional subarea 64, 66 and 68 when removed from the blister card 14. Such a spatial arrangement can also leave sufficient regulatory information behind on the blister card 14 to comply with regulatory minimums provided by a particular jurisdiction, such as the U.S. Food and Drug Administration. In some embodiments the instructional indicia 97, 99 and 101 may include a representation of the unit dose instructional subareas 64, 66 and 68 on the front side 16, which can aid in accessing the intended unit dose for a particular time period of the day. In some embodiments, for example, area 103 may be an openable door or flap 105 that can opened or removed to expose the rupturable layer 302 therebehind for removal of the unit dose.

As can be seen, the instructional indicia 96, 97, 99 and 101 are flipped upside down relative to the orientation of the manufacturer indicator 62 (FIG. 5). This may encourage the user, when viewing the front side 16, to flip the blister card 14 about its horizontal axis $A_1$ to read the instructional indicia 96 on the back side 18. In some embodiments, the instructional indicia may also be flipped left-to-right or right-to-left to encourage the user to flip the blister card about its vertical axis $A_2$.

The blister card 14 described above is somewhat rectangular in shape with the unit dose instructional subareas 64, 66 and 68 being continuous and aligned along a common, substantially linear boundary, however, other shapes and arrangements are possible. Referring to FIG. 9, a substantially circular or rounded blister card 100 includes multiple unit doses 102, 104 and 106 that are all to be consumed on a daily basis (i.e., within a 24 hour period). As above, the blister card 100 includes information that aids a user in understanding how and when to take the unit dose carried by the blister card 100.

Figure 10:
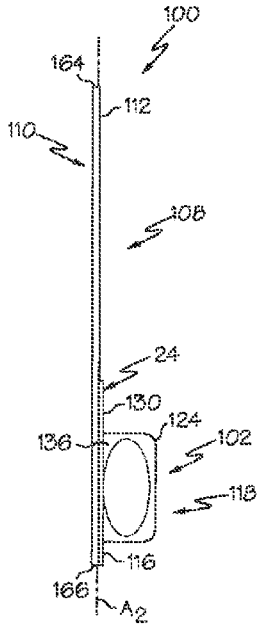
FIG. 10 is a side view of the blister card of FIG. 9.
Figure 11:
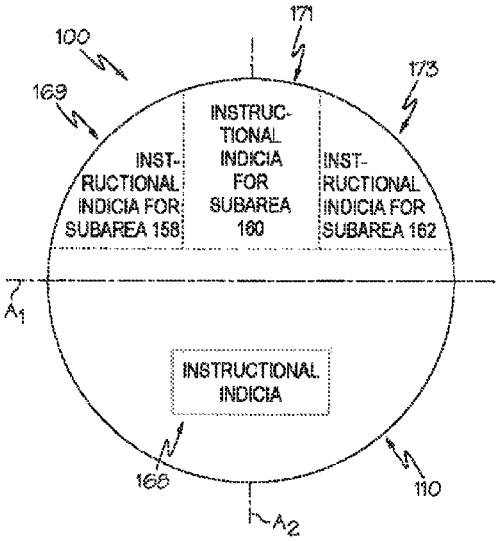
FIG. 11 is a rear view of the blister card of FIG. 9.

Referring also to FIGS. 10 and 11, the blister card 100 includes a front side 108 and a back side 110 opposite the front side 108. The front side 108 includes a face 112 having an outer, substantially circular periphery 114 and a total planar area that is bounded by the outer periphery 114. A blister sheet 116 extends over at least a portion of the face 112. The blister sheet 116 includes multiple, visible blister regions 118, 120 and 122, each including a blister 124, 126 and 128 extending outwardly from the face 112 and a shoulder region 130, 132 and 134 surrounding its respective blister 124, 126 and 128. The shoulder regions 130, 132 and 134 may be used to attach the blister sheet 116 to the rupturable layer in a manner similar to that shown by FIG. 4. The blisters 124, 126 and 128 each form a cavity 136, 138 and 140 into which one or more unit dose (e.g., tablet, capsule, liquid) can be held.

In some embodiments, each blister region 118, 120 and 122 may include a perforated boundary 142 (or other line of weakness) that allows for removal of the particular blister region 118, 120, 122 from the blister card 100. Notches 144 may be provided at corners of the blister regions 118, 120 and 122, which may serve to round corners such that a relatively square, sharp corner is not provided.

In a fashion similar to that described above, the front side 108 includes two or more primary indicia areas 146 and 148. The primary indicia area 146 is a primary manufacturer indicia area and the primary indicia area 148 is a primary unit dose indicia area. The primary manufacturer area 146 may extend continuously over the face 112 of the front side 108, may be without any blisters and unit dose and may include at least one manufacturer indicator 153, such as a logo, manufacturer name, etc. to provide the user an indicator of the manufacturer or origin of the blister card 100.

The primary unit dose indicia area 148 may correspond to the area occupied on the face 112 of the front side 108 by the visible blister regions 118, 120 and 122 of the blister sheet 116. In some embodiments, the primary unit dose indicia area 148 includes two or more unit dose instructional subareas 152, 154 and 156. Each unit dose instructional subarea 152, 154 and 156 may be visible to the user and include an instructional indicator 158, 160 and 162 that indicates a period of day that the unit dose associated with the unit dose instructional subarea 158, 160 and 162 is to be consumed in a fashion similar to those described above including colors, images, numbers and text.

In some embodiments, for the blister card 100 having a substantially circular shaped outer periphery, such as seen in FIG. 9, no more than about 40 percent of the total planar area bounded by the outer periphery 114 is covered by the projected cavity areas of the blisters 124, 126 and 128. For example, in some embodiments of a substantially circular blister card 100, no more than about 28 percent of the total planar area bounded by the outer periphery 114 is covered by the projected cavity areas, such as no more than about 18 percent.

The blister card 100, being circular, has a horizontal axis $A_1$ extending along a width of the blister card 100 and a vertical axis $A_2$ extending along a height of the blister card 100. The axes $A_1$ and $A_2$ correspond to a diameter of the blister card 100. Horizontal and vertical is with reference to when the face 112 is in a vertical orientation with the manufacturer indicator 153 in the illustrated upright orientation. The primary manufacturer indicia area 146 extends continuously from the primary unit dose area 148 along the height (i.e., in the direction of the vertical axis $A_2$) to an upper portion 164 of the round outer periphery 114. The primary manufacturer indicia area 150 also extends continuously along the width (i.e., in the direction of the horizontal axis $A_1$).

The primary unit dose indicia area 148 extends continuously from the primary manufacturer indicia area 146 along the height (i.e., in the direction of the vertical axis $A_2$) to a lower portion 166 of the outer periphery 114. The primary unit dose indicia area 148 also extends continuously along the width (i.e., in the direction of the horizontal axis $A_1$).

Referring to FIG. 11, the back side 110 of the blister card 100 is illustrated where the blister card 100 is flipped about its horizontal axis $A_1$. Instructional indicia 168 is printed and viewable on the back side 110 of the blister card 100. The instructional indicia 168 may include regulatory information, dosage details, ingredients, manufacturer information, warnings, etc. The instructional indicia 168 including the regulatory information may pertain to any one or all of the unit doses within the unit dose instructional subareas 152, 154 and 156. The instructional indicia 168 including any regulatory information may be located such that the regulatory information is not damaged when a unit dose is removed from at least one of the at least three blisters through the back side 110. As above, instructional indicia 169, 171 and 173 may also be present on the back side of each of the unit dose instructional subareas 152, 154 and 156 to maintain a spatial orientation with the unit dose instructional subareas 152, 154 and 156 on the front side 108. The instructional indicia 168, 169, 171 and 173 may also be flipped relative to the orientation of the manufacturer indicator 153 to encourage the user, when viewing the front side 110, to flip the blister card 100 about its horizontal axis $A_1$ or vertical axis $A_2$ to read the instructional indicia.

Figure 12:
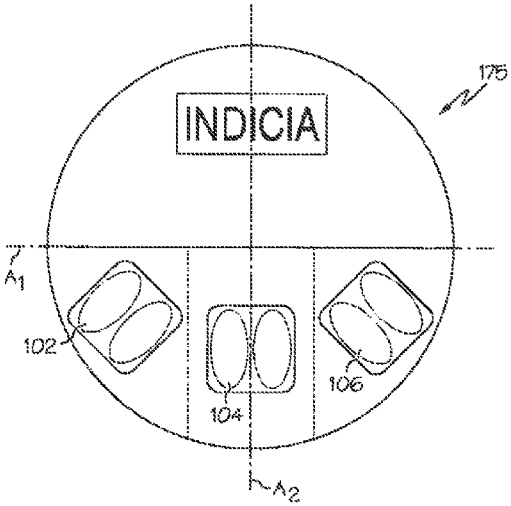
FIG. 12 is a front view of another embodiment of a blister card.

In some embodiments, such as the ones described above, the unit dose may be in the form of vertically-oriented tablets. In the embodiment of FIG. 2, only one tablet 13 or 15 is illustrated per blister. In FIG. 9, more than one tablet 102, 104 and/or 106 (e.g., two tablets) are illustrated per blister and arranged vertically (i.e., in parallel to axis $A_2$). In some embodiments, there may be more than three blisters, such as no less than four to no more than five blisters per blister card. Referring to FIG. 12, in an alternative embodiment, the tablets 102, 104 and/or 106 may be arranged offset to vertical, but include many of the features described above.

Figure 13:
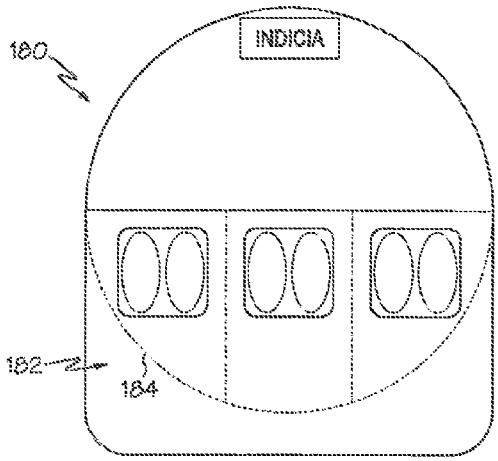
FIG. 13 is a front view of another embodiment of a blister card.
Figure 14:
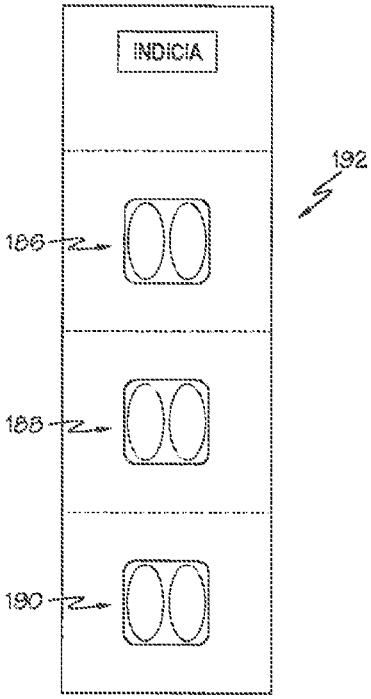
FIG. 14 is a front view of another embodiment of a blister card.
Figure 15:
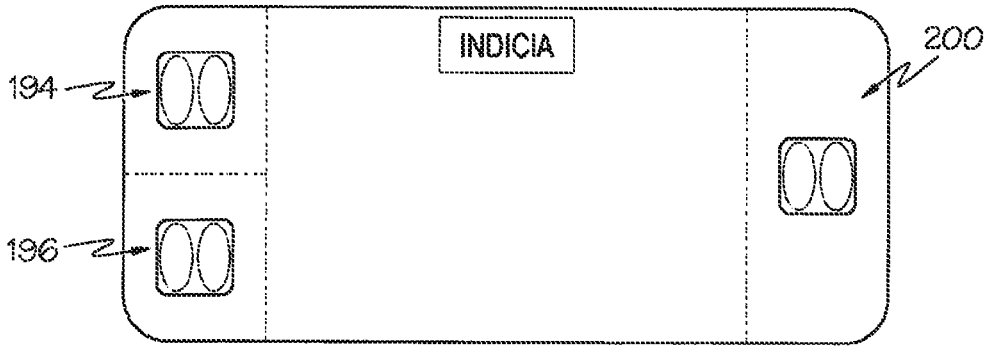
FIG. 15 is a front view of another embodiment of a blister card.
Figure 16:
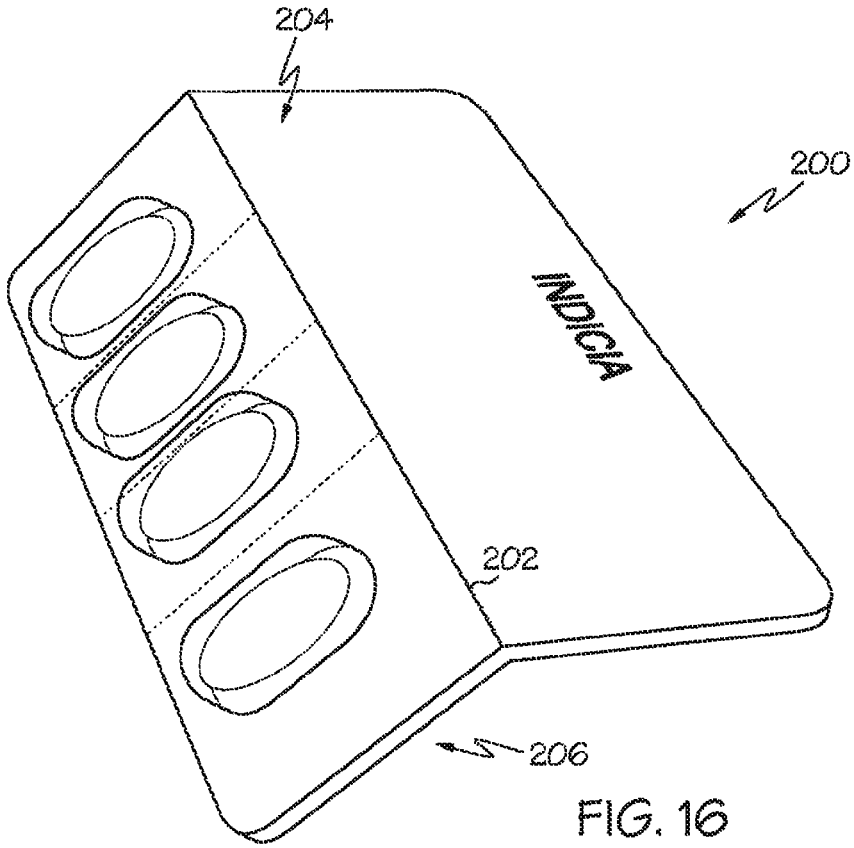
FIG. 16 is a perspective view of another embodiment of a blister card.

Referring to FIG. 13, another embodiment of a blister card 180 includes a frangible portion 182 that can be separated along a tear line 184 to form a round blister card 180 similar to or the same as the blister card 100. In these embodiments, the total planar area calculation bounded by the outer periphery may include the frangible portion 182. In another embodiment, referring to FIG. 14, blister regions 186, 188 and 190 of blister card 192 may be arranged vertically. Referring to FIG. 15, in yet another embodiment, blister regions 194 and 196 of blister card 198 may be separated from blister region 201. Foldable blister cards may also be provided. Referring to FIG. 16, a blister card 200 may include a fold line 202 that is formed in a formed and/or back side 204, 206 of the blister card 200 that allows the blister card 200 to fold in a book-like fashion. In these embodiments, the total frangible area calculation bounded by the outer periphery may be calculated using the unfolded state of the blister card 200. In these embodiments, no more than about 15 percent of the total planar area bounded by the outer periphery may be covered by the projected cavity areas for a foldable blister card 200.

Generally, the systems described above are directed to a blister package, blister card or blister sheet, all used interchangeably. The blister cards can be of varying shape and size as desired based upon the number, size and type of dosing units contained therein, and can be sized to be conveniently portable. Non-limiting examples of such shapes include round, circular, oval, rectangular, square, triangular, trapezoidal, octagonal, and combinations thereof. It has been found, that users, particularly males, prefer a blister card with rounded corners because these blister cards are more comfortable to carry in their pockets. Therefore, the blister cards of the present invention can have rounded corners or be circular in shape. In one example, the blister card is rectangular with rounded corners. Furthermore, users, particularly women preferred a unique shape, such as a circular blister card, because it was easier for them to find in their purse or handbag. The blister cards can also be formed to have means to permit separation of one or more portions of the blister cards, i.e. one or more portions containing an enclosure. Non-limiting examples of such means include perforations, scoring and combinations thereof.

The blister card can be any size. It has been found that users prefer a small blister card that is easily transportable. In one embodiment, the blister card is portable and can easily fit in a purse, wallet, or pocket. For example, the blister card can be from about 50 mm to about 120 mm wide, from about 60 mm to about 100 mm wide, and from about 65 mm to about 95 mm wide and from about 30 mm to about 100 mm tall, from about 40 mm to about 90 mm tall, from about 50 mm to about 80 mm tall, and from about 60 mm to about 70 mm tall. In another embodiment, the blister card can be from about 50 mm to about 150 mm wide, from about 70 mm to about 130 mm wide, and from about 90 mm to about 120 mm wide and from about 40 mm to about 120 mm tall, from about 50 mm to 180 mm tall, and from about 65 mm to about 140 mm tall. In yet another example, the blister card can be from about 20 mm to about 90 mm wide, in another embodiment from about 30 mm to about 70 mm wide, and in another embodiment from about 40 mm to about 60 mm wide and from about 20 mm to about 90 mm tall, in another embodiment from about 30 mm to about 70 mm tall, and in another embodiment from about 40 mm to about 60 mm tall.

The blister cards can include one or more blister sheets on the front sides and a rupturable layer on the back sides, the combination of which encloses one or more dosage units. The blister sheet provides enclosures, in any suitable size and/or shape, for one or more dosage units of any suitable size, shape or form. The rupturable layer permits the dosage unit to be removed from the blister card. The rupturable layer can be formed over all or a portion of the blister sheet. The rupturable layer can be affixed to the blister sheet via the application of heat and pressure or by adhesive, as examples. Such blister cards can also comprise a backing layer that can be disposed on or over the rupturable layer to prevent unintended rupture and release of dosage units. Such a backing layer can be peeled away to expose the rupturable layer when release of a dosage unit is desired. Such backing layers can be formed over all or a portion of the rupturable layer. Such a backing layer can be affixed to the rupturable layer and/or the blister layer via, for example, adhesive.

Blister sheets can be made from a variety of suitable materials, non-limiting examples of which include polyvinyl chloride, thermoplastic materials, polyolefins, glycol-modified polyethylene terephthalate (PETG), and combinations thereof. The blister sheet can be partially opaque or transparent, and can be colorless or colored.

Rupturable layers can be made from a variety of suitable materials, non-limiting examples of which include metal foil, tempered metal foil, paperboard, polyvinyl chloride, polyester, polyolefins, polystyrenes, polyesters, fluoropolymer resins, and combinations thereof. The rupturable layer can also be formed as a laminate composed of a plurality of laminated layers of different materials, so long as its basic operation and rupturability is not affected. The rupturable layer can be of any desired color.

Backing layers can be made from a variety of suitable materials, non-limiting examples of which include paper, plastic, polyvinyl chloride, and combinations thereof. The backing layer can be of any desired color. In some examples, the blister cards may include child or tamper resistant features. And in another example, the blister card is child-resistant per United States standards. The United States standards for child-resistant packaging can be found in the Code of Federal Regulations Title 16: Part 1700.

The blister cards can include any number of blisters and unit doses. In one example, the blister card includes about 24 hours of unit doses according to the dosing instructions, in another example the blister card includes about 16 hours of unit doses according to dosage instructions, and in another example the blister card includes about 12 hours of unit doses according to dosage instructions. In one example the blister card only contains medication intended for use during the day, for example the card can contain three doses of daytime MSR cold/flu unit doses.

Each blister can have one unit dose or a plurality of unit doses. In one example, each blister can have one unit dose, in another example the blister can comprise two unit doses, and in another embodiment each blister can have more than 2 unit doses. In one example the blister card can have 1 blister, in another example 2 blisters, in another example 3 blisters, in another example 4 blisters, and in another example 5 blisters. Each blister can contain one unit dose. In one example, each blister can contain 1 tablet, in another example each blister can contain 2 tablets, and in another example each blister can contain more than 2 tablets.

It has been found that users prefer no more than five unit doses for twenty-four hours of treatment. In one example, the blister card can contain 5 unit doses, in another example 4 unit doses, in another example 3 unit doses, and in another example 2 unit doses. The unit dose can be the same composition or a different composition. In one example there can be 3 unit doses all with daytime MSR cold/flu actives. In another example, there can be 2 unit doses all with daytime MSR cold/flu actives. In another example, there can be 4 unit doses and 3 unit doses are daytime MSR cold/flu actives and 1 unit dose is nighttime MSR cold/flu actives.

The blister card can be packaged with other blister cards as in FIG. 1 or it can be packaged with other items. In one example, the kit can comprise a first blister card and a second blister card, the first blister card can contain a first active ingredient and the second card can contain a second active ingredient and the first active ingredient and the second active ingredient can be different. In one example, the first active ingredient can be daytime MSR cold/flu active and the second active ingredient can be nighttime MSR cold/flu active. In another example, the first blister card can comprise from about 12 hours to about 16 hours of actives according to the dosing instructions and the second blister card can contain one or more unit doses of nighttime actives.

In another example, the kit can comprise a blister card and liquid unit doses. The blister card can comprise from about 12 hours to about 16 hours of actives according to the dosing instructions and the liquid unit doses can comprise a different active, for example an active that is intended to be taken at night, such as nighttime MSR cold/flu unit dose. In another example, the kit can comprise more than one blister card.

The actives carried by the blister cards can be selected from the following non-limiting list of actives: non-prescription pharmaceutical actives, prescription pharmaceutical actives, vitamins, minerals, elements, plant-derived materials, energy-boosting materials, probiotics, supplements, fiber, prebiotics, and combinations thereof. Such actives are grouped generally below for ease of presentation, but as would be understood by those of skill in the art, there is overlap in usage of many of the actives described herein—for example such actives as anti-inflammatory and/or pain actives which can be used with respiratory conditions, gastrointestinal conditions, muscle and joint conditions, menstrual conditions and the like. When used in the systems, methods and cards, prescription actives can be administered according to a prescribed regimen and can be combined in a system or kit with additional, non-prescription actives.

The dosage units and systems can comprise one or more actives useful to treat a respiratory condition. Respiratory conditions encompass a broad range of conditions, including viral infections such as cold and flu, bacterial infections, as well as allergies, sinusitis, rhinitis, asthma, and the like. Respiratory conditions may present with any of a variety of symptoms, such as runny nose, nasal and/or chest congestion, cough, sneezing, pressure, headache, aches, fever, fatigue and/or sore throat. Actives typically used to treat these symptoms generally fall into the following classifications: decongestants, anti-cholinergics, expectorants, antihistamines, antitussives, analgesics, anti-virals, mucolytics, demulcents, anesthetics, and antibiotics. Such actives can include non-prescription pharmaceutical actives and prescription pharmaceutical actives.

Dosage units for treating respiratory symptoms associated with respiratory conditions can be manufactured in a number of product forms. Non-limiting examples of the most common include tablets, dragees, caplets, softgel capsules, solid-filled capsules, liquid-filled capsules, enteric-coated forms, sustained-release forms, solid lozenges, liquid-filled lozenges, mouth and throat drops, gums, confectionaries, "gummies", effervescent tablets, dry dissolvable powders (for example in sachets or stick packs), dissolvable film strips, sublingual tablets, buccal tablets, syrups, elixirs and liquids for swallowing, treats, biscuits, patches for transdermal administration of an active, topical anti-microbial compositions, as well as inhalants and topical creams and lotions that release volatile agents that are inhaled through the nose into the respiratory tract, and combinations thereof. Oral compositions are typically swallowed immediately, or slowly dissolved in the mouth.

Such dosage units can be prepared by any known or otherwise effective technique as would be understood by those of skill in the art.

Non-limiting examples of non-prescription pharmaceutical actives and prescription pharmaceutical actives suitable for use with respiratory conditions include:

decongestants, non-limiting examples of which include pseudoephedrine, phenylephrine, phenylpropanolamine, oxymetazoline, xylometazoline, naphazoline, 1-desoxyephedrine, ephedrine, propylhexedrine, and combinations thereof;

anticholinergics, non-limiting examples of which include ipratropium, chlorpheniramine, brompheniramine, diphenhydramine, doxylamine, clemastine, triprolidine, and combinations thereof;

expectorants, non-limiting examples of which include guaifenesin, ambroxol, bromhexine, and combinations thereof;

antihistamines, non-limiting examples of which include chlorpheniramine, desloratadine, levocetirizine, diphenhydramine, doxylamine, triprolidine, clemastine, pheniramine, brompheniramine, dexbrompheniramine, loratadine, cetirizine and fexofenadine, amlexanox, alkylamine derivatives, cromolyn, acrivastine, ibudilast, bamipine, ketotifen, nedocromil, omalizumab, dimethindene, oxatomide, pemirolast, pyrrobutamine, pentigetide, thenaldine, picumast, tolpropamine, ramatroban, repirinast, suplatast tosylate aminoalkylethers, tazanolast, bromodiphenhydramine, tranilast, carbinoxamine, traxanox, chlorphenoxamine, diphenylpyaline, embramine, p-methyldiphenhydramine, moxastine, orphenadrine, phenyltoloxamine, setastine, ethylenediamine derivatives, chloropyramine, chlorothen, methapyrilene, pyrilamine, talastine, thenyldiamine, thonzylamine hydrochloride, tripelennamine, piperazines, chlorcyclizine, clocinizine, homochlorcyclizine, hydroxyzine, tricyclics, phenothiazines, mequitazine, promethazine, thiazinamium methylsulfate, azatadine, cyproheptadine, deptropine, desloratadine, isothipendyl, olopatadine, rupatadine, antazoline, astemizole, azelastine, bepotastine, clemizole, ebastine, emedastine, epinastine, levocabastine, mebhydroline, mizolastine, phenindamine, terfenadine, tritoqualine, and combinations thereof.

anti-tussives (cough suppressants), non-limiting examples of which include dextromethorphan, menthol, codeine, chlophedianol, levodropropizine, and combinations thereof;

pain relievers non-limiting examples of which include acetaminophen, ibuprofen, ketoprofen, diclofenac, naproxen, aspirin, and combinations thereof, as well as prescription analgesics, non-limiting examples of which include propyxhene HCl, codeine, mepridine, and combinations thereof;

anti-virals, non-limiting examples of which include amantidine, rimantidine, pleconaril, zanamivir, oseltamivir, and combinations thereof;

mucolytics, non-limiting examples of which include ambroxol, N-acetylcysteine, and combinations thereof;

demulcents, non-limiting examples of which include glycerin, honey, pectin, gelatin, slippery elm bark, liquid sugar, glycyrrhizin (licorice) and combinations thereof;

anesthetics, non-limiting examples of which include phenol, menthol, dyclonine HCl, benzocaine, lidocaine, hexylresorcinol, and combinations thereof;

antibiotics, non-limiting examples of types of which include nitroimidazole antibiotics, tetracyclines, penicillin-based antibiotics such as amoxicillin, cephalosporins, carbopenems, aminoglycosides, macrolide antibiotics, lincosamide antibiotics, 4-quinolones, fluoroquinolones, rifamycins, macrolides, nitrofurantoin, and combinations thereof; and any pharmaceutically acceptable salts, metabolites, and combinations thereof of the above-listed actives.

In one example, the dosage units are MSR cold/flu dosage units that can comprise one or more cold/flu actives and can be used to treat one or more cold/flu symptoms.

The cold/flu symptoms can be selected from the group consisting of nasal/sinus congestion, runny nose, sneezing, headache, dry cough, sore throat, sinus pressure or pain, chest congestion, muscle aches/pains, wet/chesty cough, fever, and combinations thereof.

Cold/flu actives can include decongestants, expectorants, antihistamines, anti-tussives, pain relievers, and combinations thereof. In one example, the decongestant is selected from the group consisting of pseudoephedrine, phenylephrine, and combinations thereof. In one example, the expectorant can be guaifenesin. In one example, the antihistamine can be chlorpheniramine. In one example the anti-tussive can be selected from the group consisting of dextromethorphan, codeine, and combinations thereof. In one example the pain relievers can include acetaminophen, ibuprofen, or combinations thereof. In one example, the cold/flu dosage unit, in particular the daytime formulation, can further comprise caffeine which is a stimulant.

In one example, the dosage units comprise one or more cold/flu actives, in another example the dosage units comprise two or more cold/flu actives, in another example the dosage units comprise three or more cold/flu actives, and in another example the dosage units comprise four or more cold/flu actives. In one example, the dosage unit comprises exactly one cold/flu active, in another example exactly two cold/flu actives, in another example exactly three cold/flu actives, and in another example exactly four cold/flu actives. In one example the dosage units comprise acetaminophen, dextromethorpan, and phenylephrine.

The dosage units can comprise from about 0% to about 90%, alternatively from about 0.0001% to about 75%, alternatively from about 0.001% to about 50%, alternatively from about 0.01% to about 25%, alternatively from about 0.01% to about 15%, and alternatively from about 0.01% to 10% respiratory active or cold/flu active, by weight of the composition forming the dosage unit.

The dosage units can comprise from about 0.001 milligram (mg) to about 1000 mg, alternatively from about 2.5 mg to about 750 mg, and alternatively from about 5 mg to about 650 mg of the respiratory active or cold/flu active, per dosage unit. In one example, the dosage units can comprise from about 100 mg to about 700 mg pain reliever, in another example from about 200 mg to about 600 mg, an in another example from about 275 mg to about 550 mg, per dosage unit. In another example, the dosage units can comprise from about 2 mg to about 15 mg anti-tussive, in another example from about 4 mg to about 14 mg, and in another example from about 7 mg to about 12 mg, per dosage unit. In another example, the dosage units can comprise from about 50 mg to about 400 mg expectorant, in another example from about 75 mg to about 300 mg, and in another example from about 150 mg to about 250 mg, per dosage unit. In another example the dosage units can comprise from about 1 mg to about 10 mg decongestant, in another embodiment from about 3 mg to about 8 mg, and in another embodiment from about 4 mg to about 6 mg, per dosage unit.

The dosage units can also comprise other actives useful to treat respiratory conditions, non-limiting examples of which include vitamins, minerals, elements, plant-derived materials, supplements, energy-boosting materials, probiotics, fiber, prebiotics, and combinations thereof. Such other actives are described below.

The dosage units can be administered in a single daily dose, or multiple daily doses.

The dosage units and systems can comprise one or more actives useful to treat a gastrointestinal condition. Gastrointestinal conditions encompass a broad range of conditions, including viral infections, bacterial infections, autoimmune conditions, genetic conditions and the like. Gastrointestinal conditions may present with any of a variety of symptoms, associated with a disruption in function of the digestive system, such as diarrhea, constipation, upset stomach, vomiting, sour stomach, cramps, gas, bloating, stomach ache, and the like. Actives typically used to treat these symptoms generally fall into the following classifications: laxative, anti-diarrheal, anti-emetic, anti-inflammatory, antacid, rafting agents and anti-flatulent. Such actives can be non-prescription pharmaceutical actives and prescription pharmaceutical actives.

Dosage units for treating gastrointestinal symptoms associated with gastrointestinal conditions can be manufactured in a number of product forms, non-limiting examples of the most common including tablets, dragees, caplets, softgel capsules, solid-filled capsules, liquid-filled capsules, enteric-coated forms, sustained-release forms, solid lozenges, liquid-filled lozenges, mouth and throat drops, gums, confectionaries, "gummies", effervescent tablets, dry dissolvable powders, dissolvable film strips, sublingual tablets, buccal tablets, syrups, elixirs and liquids for swallowing, patches for transdermal administration of actives, treats, biscuits, suppositories, as well as topical creams and lotions that release agents that are absorbed into and through the skin and/or mucus membranes into the gastrointestinal tract, and combinations thereof.

Non-limiting examples of non-prescription and prescription pharmaceutical actives suitable for use with gastrointestinal conditions include:

anti-diarrheal, non-limiting examples of which include loperamide, bismuth-containing compositions, bismuth subsalicylate, colloidal bismuth subcitrate, bismuth subcitrate, kaolin, pectin, clays such as attapulgite, activated charcoal, and combinations thereof;

laxative, non-limiting examples of which include fiber, resistant starch, resistant maltodextrin, pectin, cellulose, modified cellulose, polycarophil, senna, sennosides, bisacodyl, sodium phosphate, docusate, magnesium citrate, mineral oil, glycerin, aloe, castor oil, magnesium hydroxide, and combinations thereof;

anti-nausea and anti-emetic, non-limiting examples of which include bismuth containing compositions, phosphated carbohydrates, diphenhydramine, cyclizine, meclizine, and combinations thereof;

antacid, non-limiting examples of which include sodium bicarbonate, sodium carbonate, calcium carbonate, magnesium carbonate, magnesium hydroxide, aluminum hydroxide, magnesium silicates, alginic acids, sodium alginate, magaldrate, and combinations thereof;

anti-flattulent/anti-gas, non-limiting examples of which include simethicone, activated charcoal, lactase, alpha-galactosidase enzymes, and combinations thereof;

H2 receptor antagonists, non-limiting examples of which include famotidine, ranitidine, ciemtidine, nitazidine, and combinations thereof;

proton pump inhibitors, non-limiting examples of which include omeprazole, lansoprazole, esomeprazole, pantoprazole, rabeprazole, and combinations thereof;

anti-inflammatories, non-limiting examples of which include mesalamine; and any pharmaceutically acceptable salts, metabolites, and combinations thereof;

rafting agents non-limiting examples of which include alginates; pectins and polysaccharides, and combinations thereof of the above-listed actives.

The dosage units can comprise from about 0.001% to about 99%, alternatively from about 0.01% to about 99%, alternatively from about 0.1% to about 99%, alternatively from about 1% to about 99%, and alternatively from about 5% to about 95%, non-prescription or prescription pharmaceutical active, by weight of the composition forming the dosage unit.

The dosage units can comprise from about 0.001 mg to about 5 g, alternatively from about 0.01 mg to about 2 g, alternatively from about 0.1 mg to about 1000 mg, and alternatively from about 1 mg to about 1000 mg of non-prescription or prescription pharmaceutical active, per dosage unit.

The dosage units can also comprise other actives useful to treat gastrointestinal conditions, non-limiting examples of which include vitamins, minerals, elements, plant-derived materials, supplements, energy-boosting materials, probiotics, fiber, prebiotics, and combinations thereof. Such other actives are described below.

The dosage units can be administered in a single daily dose or multiple daily doses.

The dosage units and systems can comprise one or more other actives which can be used to treat and/or prevent respiratory conditions, can be used to treat and/or prevent gastrointestinal conditions, and can be used to treat and/or prevent various other conditions and/or also provide benefits for overall health and well-being. Overall health and well-being encompasses a broad range of desired benefits and benefit types, including respiratory health, gastrointestinal health, immune health, mobility and joint health, cardiovascular health, skin health, oral/dental health, hair health, eye health, reproductive health (including menstrual health), ear, nose and throat health, and the like.

Users may desire a variety of benefits, non-limiting examples of which include reduced incidence and severity of respiratory conditions and symptoms thereof; reduced incidence and severity of gastrointestinal conditions and symptoms thereof; reduced incidence and severity of menstrual symptoms; reduced incidence and severity of symptoms of disorders of the ear, nose and throat; reduced incidence and severity of symptoms and effects of: inflammatory disorders, immunodeficiency, cancer (particularly those of the gastrointestinal and immune systems), appendicitis, autoimmune disorders, multiple sclerosis, Alzheimer's disease, amyloidosis, rheumatoid arthritis, arthritis, diabetes mellitus, insulin resistance, bacterial infections, viral infections, fungal infections, periodontal disease, urogenital disease, surgical associated trauma, surgical-induced metastatic disease, sepsis, weight loss, weight gain, excessive adipose tissue accumulation, anorexia, fever control, cachexia, wound healing, ulcers, gut barrier infection, circulatory disorders, coronary heart disease, anaemia, disorders of the blood coagulation system, renal disease, disorders of the central nervous system, hepatic disease, ischaemia, nutritional disorders, osteoporosis, endocrine disorders, and epidermal disorders.

Non-limiting examples of health benefits include ameliorating or reducing the effects of aging including mental awareness and activity levels, preventing weight loss during and following infection; improving glucose control, including improving insulin sensitivity, reducing insulin resistance, and attenuating postprandial glucose absorption; good, maintained and/or improved mobility and joint function; lowered cholesterol and lowered blood pressure; improved skin look and tone, improved hair look and feel, and combinations thereof.

Non-limiting examples of such other actives used to provide such benefits include vitamins, minerals, elements, plant-derived materials, energy-boosting materials, probiotics, fiber, prebiotics, and combinations thereof.

Dosage units suitable for use with the other actives herein are manufactured in a number of product forms, non-limiting examples of the most common including tablets, dragees, caplets, softgel capsules, solid-filled capsules, liquid-filled capsules, enteric-coated forms, sustained-release forms, solid lozenges, liquid-filled lozenges, mouth and throat drops, gums, confectionaries, "gummies", effervescent tablets, dry dissolvable powders, dissolvable film strips, syrups, elixirs and liquids for swallowing, suppositories, sublingual tablets, buccal tablets, patches for transdermal delivery of actives, drinks, and food products including treats and biscuits; as well as topical anti-microbial compositions, topical creams and lotions that release agents that are absorbed into and through the skin and/or mucus membranes, inhalants and topical creams and lotions that release volatile agents that are inhaled through the nose into the respiratory tract.

The dosage units and systems of the present invention can comprise one or more vitamins, non-limiting examples of which include provitamin and all forms of Vitamins C, D, A, B, E, and combinations thereof.

When certain vitamins, (also certain minerals, metals, elements and the like), are included as components in capsule, tablet and powder forms, the actual amounts of these many of these components, in grams per unit dose, are often extremely small, and make the individual components difficult to handle, measure and process. Therefore such components are commonly prepared or purchased as a premix in or on a carrier such as sucrose or lactose. With respect to the weight percent of a given vitamin as a percent of a premix or vitamin-carrier mix, such percentages can vary greatly depending on the vitamin and the amount of vitamin desired, as would be understood by one of skill in the art. Generally, however, for vitamins in or on a carrier, the vitamin can comprise, as a weight percent of vitamin to carrier, from about 0.0001% to about 50%, alternatively from about 0.001% to about 45%, alternatively from about 0.001% to about 40%, by weight of the vitamin-carrier composition.

The dosage units and systems of the present invention can comprise Vitamin C. It is believed that over 20% of subjects with colds have suboptimal levels of Vitamin C. The preferred form of Vitamin C for use in the present invention is as ascorbic acid or an equivalent salt of ascorbic acid (i.e. calcium ascorbate) or an equivalent derivative of ascorbic acid. The vitamin C can either be in an immediate release form or a sustained release form.

The Vitamin C can be administered in a single daily dose or multiple daily doses.

The dosage units can comprise from about 1 mg to about 5000 mg, alternatively from about 20 mg to about 2000 mg, alternatively from about 60 mg to about 1500 mg, and alternatively from about 100 mg to about 1000 mg of Vitamin C, per dosage unit.

The systems can provide from about 1 mg to about 5000 mg, alternatively from about 20 mg to about 2000 mg, alternatively from about 60 mg to about 1500 mg, and alternatively from about 100 mg to about 1000 mg of Vitamin C, per day.

The dosage units and systems can comprise Vitamin D. Non-limiting examples of Vitamin D suitable for use in the present invention include Vitamin D3 (cholecalciferol), Vitamin D2 (ergocalciferol) and combinations thereof. Additional non-limiting examples include metabolites of Vitamin D including calcidiol, calcitriol and combinations thereof. The Vitamin D can be derived from natural or synthetic sources, including from an extract of *solanum glaucophylum* (malacoxylon), *trisetum flavescens* (goldhafer) or *cestrum diurnum*. Both the pure Vitamin D and/or glycosides of the Vitamin D can be used. Vitamin D can be used to treat and/or prevent a respiratory condition, and/or provide overall health and wellness benefits.

The Vitamin D can be administered in a single daily dose or multiple daily doses.

The dosage units can provide, in a single daily dose or multiple daily doses, from about 50 IU to about 500,000 IU, alternatively from about 500 IU to about 500,000 IU, alternatively from about 1,000 IU to about 500,000 IU, alternatively from about 2,000 IU to about 100,000 IU, alternatively from about 10,000 IU to about 50,000 IU, and alternatively from about 20,000 IU to about 40,000 IU, of cholecalciferol per day.

To treat symptoms of a respiratory condition that is already underway, a mammal, for example a human, can be administered, in a daily single dose, or multiple daily doses, from about 50 IU to about 500,000 IU, alternatively from about 500 IU to about 500,000 IU, alternatively from about 1000 IU to about 500,000 IU, alternatively from about 5,000 IU to about 500,000 IU, alternatively from about 10,000 IU to about 100,000 IU, and alternatively from about 20,000 to about 50,000 IU of cholecalciferol per day.

To treat or prevent the symptoms of a respiratory condition, a mammal can be administered, in a single dose or multiple daily doses, from about 50 IU to about 10,000 IU, alternatively from about 500 IU to about 10,000 IU, alternatively from about 1,000 IU to about 5,000 IU, alternatively from about 2,000 IU to about 5,000 IU, and alternatively from about 2,000 IU to about 4,000 IU of cholecalciferol per day.

The dosage units and systems can also provide Vitamin D2 (ergocalciferol). The dosage units can provide, in a single daily dose or multiple daily doses, from about 50 IU to about 500,000 IU, alternatively from about 500 IU to about 500,000 IU, alternatively from about 1,000 IU to about 500,000 IU, and alternatively from about 5,000 IU to about 500,000 IU of Vitamin D2, per day.

The dosage units can comprise from about 1.25 microgram (μg) to about 12.5 mg, alternatively from about 12.5 μg to about 12.5 mg, alternatively from about 25 μg to about 12.5 mg, and alternatively from about 125 μg to about 12.5 mg of Vitamin D3 and/or D2, per dosage unit.

The dosage units and systems can also comprise Vitamin A and/or pro-vitamin forms of vitamin A such as carotene(s). Vitamin A and carotene can be obtained from either animal or plant sources. The animal form of carotene is divided between retinol and dehydroretinol whereas the plant carotene can be split into four very potent groups—alpha-carotene, beta-carotene, gamma-carotene and crypto-carotene. Vitamin A can provide a variety of overall health and wellness benefits.

Non-limiting examples of the Vitamin A useful in the present invention include vitamin A, retinol, retinyl palmitate, retinyl acetate, retinyl proprionate, beta-carotene, alpha-carotene, beta-cryptoxanthin, and mixtures thereof.

The Vitamin A can be administered in a single daily dose or multiple daily doses.

The dosage units and systems can provide, in a single daily dose or multiple daily doses, from about 100 IU to about 10,000 IU, alternatively from about 300 IU to about 5,000 IU, alternatively from about 400 IU to about 2,000 IU, and alternatively from about 500 IU to about 1,000 IU of Vitamin A, per day. The amount of Vitamin A species can be expressed as IU or as RAE (Retinol Activity Equivalent), which is equal to an equivalent amount of retinol in micrograms. For example, 10,000 IU Vitamin A is equivalent to 3000 RAE or 3000 μg retinol.

The dosage units can comprise from about 30 μg to about 4545 μg, alternatively from about 90 μg to about 1500 μg, alternatively from about 120 μg to about 600 μg, and alternatively from about 150 μg to about 300 μg of Vitamin A (as retinol), per dosage unit.

The dosage units and systems can comprise one or more B Vitamins. Compositions containing eight specific B Vitamins are generally referred to as a "Vitamin B complex". Individual B Vitamin compositions are referred to by the specific name of each vitamin (e.g. $B_1$, $B_2$, $B_3$, etc). The B Vitamins often work together to deliver a number of health benefits non-limiting examples of which include, maintenance and support of metabolic rate, maintenance of healthy skin and muscle tone, enhanced immune and nervous system function, promote cell growth and division, and together can also help combat the symptoms of stress, depression, and cardiovascular disease. All B Vitamins are water soluble, and are dispersed throughout the body. Most of the B Vitamins must be replenished daily, since any excess is excreted in the urine.

Non-limiting examples of Vitamin B include vitamin B1 (thiamin), Vitamin B2 (Riboflavin), Vitamin B3 (niacin), Vitamin B5 (pantothenic acid), Vitamin B6 (pyridoxine, pyridoxal, or pyridoxamine), Vitamin B7 (Biotin), Vitamin B9 (Folic acid), Vitamin B12 (cyanocobalmin), and combinations thereof.

B Vitamins described below can be administered in a single daily dose or multiple daily doses.

The dosage units can comprise from about 200 μg to about 50 mg, alternatively from about 400 μg to about 20 mg, and alternatively from about 500 μg to about 10 mg of Vitamin B1, per dosage unit. The systems can provide from about 200 μg to about 50 mg, alternatively from about 400 μg to about 20 mg, and alternatively from about 500 μg to about 10 mg of Vitamin B1, per day.

The dosage units can comprise from about 100 μg to about 200 mg, alternatively from about 200 μg to about 100 mg, and alternatively from about 500 μg to about 50 mg of Vitamin B2, per dosage unit. The systems can provide from about 100 μg to about 200 mg, alternatively from about 200 μg to about 100 mg, and alternatively from about 500 μg to about 50 mg of Vitamin B2, per day.

The dosage units can comprise from about 1 mg to about 500 mg, alternatively from about 2 mg to about 250 mg, and alternatively from about 5 mg to about 100 mg of Vitamin B3, per dosage unit. The systems can provide from about 1 mg to about 500 mg, alternatively from about 2 mg to about 250 mg, and alternatively from about 5 mg to about 100 mg of Vitamin B3, per day.

The dosage units can comprise from about 500 μg to about 1000 mg, alternatively from about 1000 μg to about 500 mg, and alternatively from about 2000 μg to about 100 mg of Vitamin B5, per dosage unit. The systems can provide from about 500 μg to about 1000 mg, alternatively from about 1000 μg to about 500 mg, and alternatively from about 2000 μg to about 100 mg of Vitamin B5, per day.

The dosage units can comprise from about 200 μg to about 500 mg, alternatively from about 500 μg to about 250 mg, and alternatively from about 1000 μg to about 100 mg of Vitamin B6, per dosage unit. The systems can provide from about 200 μg to about 500 mg, alternatively from about 500 μg to about 250 mg, and alternatively from about 1000 μg to about 100 mg of Vitamin B6, per day.

The dosage units can comprise from about 200 μg to about 500 mg, alternatively from about 500 μg to about 250 mg, and alternatively from about 1000 μg to about 100 mg of Vitamin B6, per dosage unit. The systems can provide from about 200 μg to about 500 mg, alternatively from about 500 μg to about 250 mg, and alternatively from about 1000 μg to about 100 mg of Vitamin B6, per day.

The dosage units can comprise from about 50 μg to about 2000 μg, alternatively from about 100 μg to about 1000 μg, and alternatively from about 200 μg to about 500 μg of Vitamin B9, per dosage unit. The systems can provide from about 50 μg to about 2000 μg, alternatively from about 100 μg to about 1000 μg, and alternatively from about 200 μg to about 500 μg of Vitamin B9, per day.

The dosage units can comprise from about 0.5 μg to about 3000 μg, alternatively from about 1 μg to about 1500 μg, and alternatively from about 2 μg to about 750 μg of Vitamin B12, per dosage unit. The systems can comprise from about 50 μg to about 2000 μg, alternatively from about 100 μg to about 1000 μg, and alternatively from about 200 μg to about 500 μg of Vitamin B9, per day.

The dosage units and systems can comprise Vitamin E. Vitamin E is a lipid soluble antioxidant and provides defenses against cellular oxidative damage. The term "Vitamin E" typically includes eight different chemical forms: four tocopherols and four tocotrienols. The most biologically active form of vitamin E is alpha-tocopherol.

The Vitamin E can be administered in a single daily dose or multiple daily doses.

The dosage units can comprise from about 1 mg to about 1000 mg of vitamin E, alternatively from about 1 mg to about 800 mg of vitamin E, and alternatively from about 2 mg to about 200 mg of vitamin E, per dosage unit.

The systems can comprise from about 1 mg to about 1000 mg of vitamin E, alternatively from about 1 mg to about 800 mg of vitamin E, and alternatively from about 2 mg to about 200 mg of vitamin E, per day.

The dosage units and systems can comprise minerals, metals and/or elements. Non-limiting examples of minerals, metals, and elements useful in the systems of the present invention include: zinc, iron, calcium, iodine, copper and selenium. Adequate intake of iron, zinc, copper and selenium support a Th1 cytokine-mediated immune response which helps circumvent an anti-inflammatory Th2 response and an increased risk of extracellular infections. When present, the minerals, metals and/or elements can be on or in a suitable carrier, and comprise from about 1% to about 50% by weight and alternatively from about 2% to about 30%, by weight of the composition comprising the mineral, metal or element and the carrier.

The minerals, metals, and elements described herein can be administered in a single daily dose or multiple daily doses.

The dosage units and systems of the present invention can comprise zinc. Zinc is a trace element important to many biological and biochemical pathways. Zinc salts are effective against pathogens in direct application, and both zinc gluconate and zinc gluconate glycine have been shown to shorten the duration of symptoms of the common cold.

The dosage units can comprise zinc in an amount from about 1 mg to about 50 mg, alternatively from about 1 mg to about 30 mg, and alternatively from about 1 mg to about 25 mg, per dosage unit.

The systems can provide zinc in an amount from about 1 mg to about 50 mg, alternatively from about 1 mg to about 30 mg, and alternatively from about 1 mg to about 25 mg, per day.

The dosage units and systems can comprise iron. Iron (as $Fe^{2+}$, ferrous ion) is a necessary trace element used by almost all living organisms. It is used in hemoglobin which carries oxygen to the cells. Too little iron can cause anemia, resulting in fatigue and tiredness and has been associated with decreased cellular immunity. However, too much iron can be lethal.

A non-limiting example of iron suitable for use with the present invention is the bisclycinate salt form of iron, available under the tradename "Ferrochel" from Albion Laboratories Inc., Clearfield, Utah, USA.

The dosage units can comprise from 2 mg to about 18 mg, alternatively from about 3 mg to about 15 mg, and alternatively from about 3 mg to about 10 mg of iron, per dosage unit.

The systems can provide from 2 mg to about 18 mg, alternatively from about 3 mg to about 15 mg, and alternatively from about 3 mg to about 10 mg of iron, per day.

The dosage units and systems can comprise calcium. Calcium is essential for all living organisms, and is a major material used in mineralization of bones and shells. Calcium is essential for the normal development and maintenance of bones and teeth.

The dosage units can comprise from about 200 mg to about 1500 mg, alternatively from about 250 mg to about 1200 mg, and alternatively from about 500 mg to about 1000 mg of calcium, per dosage unit.

The systems can provide from about 200 mg to about 1500 mg, alternatively from about 250 mg to about 1200 mg, and alternatively from about 500 mg to about 1000 mg of calcium, per day.

The dosage units and systems can comprise iodine. Iodine is required in trace amounts in most living organisms, and is commonly used in medicine. Although only generally present and required in trace amounts, iodine has a key role in overall wellness, particularly in children.

The dosage units can comprise from about 20 μg to about 1 mg iodine, alternatively from about 30 μg to about 500 μg, and alternatively from about 30 μg to about 100 μg of iodine, per dosage unit.

The systems can provide from about 20 μg to about 1 mg iodine, alternatively from about 30 μg to about 500 μg, and alternatively from about 30 μg to about 100 μg of iodine, per day.

The dosage units and systems can comprise copper. Copper is a trace element that is used for biological electron transport, wound healing, red blood cell production, and immune support and performance. Copper has been used as an antimicrobial and an anti-arthritic agent.

The dosage units can comprise from about 200 μg to 10 mg, alternatively from about 500 μg to about 9 mg, and alternatively from about 1 mg to about 9 mg, per dosage unit.

The systems can provide from about 200 μg to 10 mg, alternatively from about 500 μg to about 9 mg, and alternatively from about 1 mg to about 9 mg, per day.

The dosage units and systems can comprise selenium. Although it is toxic in large doses, selenium is an essential micronutrient for animals. In humans, selenium is a trace element nutrient which functions as a cofactor for reduction of antioxidant enzymes. Selenium may act as an antioxidant and/or enhance immune activity.

The dosage units can comprise from about 15 μg to about 400 mg, alternatively from about 20 μg to about 300 mg, and alternatively from about 50 μg to about 200 mg of selenium, per dosage unit.

The dosage units can provide from about 15 μg to about 400 mg, alternatively from about 20 μg to about 300 mg, and alternatively from about 50 μg to about 200 mg of selenium, per day.

The dosage units and systems can comprise plant-derived materials. As used herein, non-limiting examples of plant-derived materials include those used in traditional native American, Chinese, Aryuvedic and Japanese medicine, including flowers, leaves, stems and roots of plants as well as extracts and isolated active components from the flower, leaves, stems, and roots of plants.

Some particularly useful plant-derived materials are described below. Particularly useful plant-derived materials are those that have beneficial respiratory, gastrointestinal, overall health and energy effects.

The plant-derived materials can be administered in a single dose or multiple daily doses.

The dosage units and systems can also comprise plant-derived materials that can be particularly useful in preventing and/or treating respiratory conditions, and/or maintaining respiratory health. Non-limiting examples of such other plant-derived materials include: *Andrographis* (*Andrographis paniculata*), Garlic (*Allium sativum* L.), *Eleutherococcus senticosus* (Siberian ginseng), a guaiacol component (from oils of *cassia* (*Cinnamomum aromaticum*), clove (*Syzygium aromaticum, Eugenia aromaticum, Eugenia caryophyllata*), or cinnamon (*Cinnamomum zeylanicum, Cinnamomum verum, Cinnamomum loureiroi, Cinnamomum camphora, Cinnamomum tamala, Cinnamomum burmannii*)), borage seed oil (*Borago officinalis*), sage (*Salvia officinalis, Salvia lavandulaefolia, Salvia lavandulifolia*), *Astragalus* (*Astragalus membraneceus*), Boneset (*Eupatorium perfoliatum*), Chamomile (*Matricaria recutita, Chamaemelum nobile*), *Cordyceps* (*Cordyceps sinensis*), *Echinacea* (*Echinacea angustifolia* DC, *Echinacea pallida, Echinacea purpurea*), Elder (*Sambucas nigra* L.), *Euphorbia*, Ginseng (American ginseng, Asian ginseng, Chinese ginseng, Korean red ginseng, *Panax* ginseng: *Panax* ssp. Including *P. ginseng* C.C. Meyer, and *P. quinquefolius* L.), Goldenseal (*Hydrastis canadensis* L.), Greater celandine (*Chelidonium majus*), Horseradish (*Armoracia rusticana, Cochlearia armoracia*), Kiwi (*Actinidia deliciosa, Actinidia chinensis*), Maitake mushrooms (*Grifola frondosa*) Mistletoe (*Visvum album* L.), Geranium (*Pelargonium sidoides*), Peppermint/Peppermint oil (*Menthax×peperita* L.), Propolis, Slippery elm (*Ulmus rubra Muhl, Ulmus fulva Michx*), Sorrel (*Rumex acetosa* L., *Rumex acetosella* L.), Thyme/*Thymus* extract (*Thymus vulgaris* L.), Wild indigo (*Baptisia australis*), quercetin (a flavanol), and combinations and/or mixtures thereof.

Non-limiting examples of plant-derived materials include *Andrographis paniculata, Allium sativum, Eleutherococcus senticosus* (Siberian ginseng) and a guaiacol component which are described below.

The dosage units and systems can comprise an *andrographis* extract, an active component thereof, or mixtures thereof. As used herein, the *andrographis* is a plant of the genus *Andrographis*, having a limited number of species within this genus largely present in Asia. Only a few of the species are medicinal. In one embodiment, the plant is of the species *Andrographis paniculata*, which may be referenced as Kalmegh in Ayurvedic medicine. *Andrographis* is typically standardized by quantifying the total amount of andrographolides, which often make up 5 to 20% of the extract.

*Andrographis* has been shown to be effective in the treatment of colds and flu, and can aid in reducing to an extent the symptoms or duration of colds. Andrographolides are the principal components of *andrographis*.

The dosage units can comprise *Andrographis paniculata* in amounts from about 5 mg to about 50 mg, alternatively from about 10 mg to about 40 mg, and alternatively from about 15 mg to about 30 mg of andrographolides, per dosage unit.

The systems can provide *Andrographis paniculata* in amounts from about 5 mg to about 50 mg, alternatively from about 10 mg to about 40 mg, and alternatively from about 15 mg to about 30 mg of andrographolides, per day.

The dosage units and systems can comprise *Allium sativum* (garlic). *Allium sativum* has been shown to be effective at reducing many of the cytokines and chemokines involved in the immune response to viral infections. A combination of *Allium sativum*, and/or Allicin, a component of *Allium sativum*, in the compositions of the present invention may provide relief of cold and flu symptoms.

The dosage units can comprise from about 0.01% to about 90%, alternatively from about 0.1% to about 35%, alternatively from about 1% to about 15%, alternatively from about 1% to about 10%, and alternatively from about 3% to about 10% of *Allium sativum*, by weight of the composition of the dosage unit.

The dosage units can comprise from about 100 mg to about 10,000 mg, alternatively from about 200 mg to about 5000 mg, alternatively from about 500 mg to about 2000 mg of *Allium sativum*, per dosage unit.

The systems can provide from about 100 mg to about 10,000 mg, alternatively from about 200 mg to about 5000 mg, alternatively from about 500 mg to about 2000 mg of *Allium sativum*, per day.

The dosage units can comprise from about 1000 μg to about 100,000 μg, alternatively from about 2000 μg to about 50,000 μg, and alternatively from about 5000 μg to about 20,000 μg of Allicin, per dosage unit.

The systems can provide from about 1000 μg to about 100,000 μg, alternatively from about 2000 μg to about 50,000 μg, and alternatively from about 5000 μg to about 20,000 μg of Allicin, per day.

The dosage units and systems can comprise *Eleutherococcus senticosus* extract. *Eleutherococcus* is an adaptogen, is anticholesteremic, is mildly anti-inflammatory, is antioxidant, may enhance immune function, and is a nervine and an immune tonic.

The dosage units can comprise from about 0.001 mg to about 1500 mg, alternatively from about 0.01 mg to about 1000 mg alternatively about 0.1 mg to about 500 mg, alternatively from about 1 mg to about 250 mg, and alternatively from about 1 mg to about 100 mg of *Eleutherococcus senticosus* extract, per dosage unit.

The systems can provide from about 0.001 mg to about 1500 mg, alternatively from about 0.01 mg to about 1000 mg alternatively about 0.1 mg to about 500 mg, alternatively from about 1 mg to about 250 mg, and alternatively from about 1 mg to about 100 mg of *Eleutherococcus senticosus* extract, per day.

The dosage units and systems can comprise a guaiacol component. The guaiacol component can be a component mixture containing guaiacol or a 4-substituted derivative thereof. Non-limiting examples of such 4-substituted derivatives of guaiacol include eugenol, iso-eugenol, dihydroeugenol, vanillyl butyl ether, vanillin (4-formyl-guaiacol), 5-propenylguaethol, 4-ethyl-2-methoxyphenol, 4-allyl-2-methoxyphenol acetate, and 4-methyl guaiacol. In one embodiment, the 4-substituted derivative of guaiacol is eugenol.

*Cassia*, clove, and cinnamon each contain guaiacol or 4-substituted derivatives thereof, or mixtures thereof. As such, essential oils, extracts or any product derived from *cassia*, clove, cinnamon, or any mixture thereof can be used as source of the guaiacol component herein. Essential oils of *cassia*, clove, or cinnamon can be particularly useful. Clove oil can be particularly useful. Products derived from *cassia*, clove or cinnamon may contain eugenol at useful levels.

The guaiacol component can comprise from about 0.0001% to about 1%, alternatively from about 0.001% to about 0.5%, alternatively about 0.001% to about 0.07%, and alternatively from about 0.001% to about 0.02%, by weight, of the composition of a dosage unit.

Other plant-derived materials can exert beneficial effects on the gastrointestinal tract, non-limiting examples of which include soothing or demulcent effects, gas reducing or carminative effects, anti-diarrheal or astringent effects, laxative or aperient, cathartic, purgative or hydrogogue effects, analgesic, antispasmodic or relaxation effects, stimulant or bitter effects, or digestive aiding effects.

Non-limiting examples of such other plant-derived materials useful in the methods and systems include the ginger Family (Zigiberaceae), licorice root (*Glycyrrhizin glabra*), marshmallow root (*Althea officinalis, Althea radix*), Chamomile (*Matricariae flos, Chamaemelum nobile*), Fennel oil, Fennel Seed (*Foeniculum vulgare*), Caraway oil, Caraway seed (*Carum carvi, Carvi fructus, Carvi aetheroleum*), Lemon Balm (*Melissae folium, Melissa*), Horehound Herb (*Murrubii herba*), Flaxseed alpha-linoleic acid (*Lini semen*), and combinations thereof.

Materials from the ginger Family (Zigiberaceae) such as the non-limiting example of *Zingiber officinale* are useful.

Ginger can be used in a form selected from the group consisting of rhizome (root), equivalent extract, tincture, oil, infusion, decoction, crystals, powder, and combinations thereof.

The dosage units can comprise from about 50 mg to about 10 grams (g), alternatively from about 50 mg to about 5 g, and alternatively from about 100 mg to about 5 g of ginger (*Zingiber officinale*), per dosage unit.

The systems can provide from about 50 mg to about 10 g, alternatively from about 50 mg to about 5 g, and alternatively from about 100 mg to about 5 g of ginger (*Zingiber officinale*), per day.

The dosage units and systems can comprise materials having energy boosting/enhancing benefits. Such energy benefits are useful for overall health and well-being, as well as being useful in treating conditions such as respiratory and gastrointestinal conditions, to provide individuals afflicted with such conditions with more energy or a perception of more energy to enable such individuals to maintain their daily routines while treating a condition such as a respiratory or gastrointestinal condition.

Non-limiting examples of such materials include the following, many of which have multiple benefits including benefits for respiratory and gastrointestinal conditions: caffeine (a stimulant and diuretic), Vitamin B complex, green and black tea (which can be used for stimulant and diuretic properties of the caffeine contained therein), taurine, *rhodiola rosea*, Siberian ginseng (*Eleutherococcus senticosus*), Vitamin C, iron, CoQ10, L-carnitine, L-Theanine, Vitamin D, guarana (*Paullinia cupana*), magnesium, *Schizandra chinensis*, Yerba Mata (*Ilex paraguariensis*), Goji (Wolfberry), quercetin (a flavanol), amalaki (Indian gooseberry), acai (from genus *Euterpe*), maca (*Lepidium meyenii*), *ginkgo biloba*, glucuronolactone, *panax ginseng* (from species within *Panax*, a genus of 11 species of slow-growing perennial plants with fleshy roots, in the family Araliaceae), *Echinacea* (genus of nine species of herbaceous plants in the Family Asteraceae), rooibos (*Aspalathus linearis*), DHEA, aromas and aromatherapy, noni (*Morinda citrifolia*), mangosteen (*Garcinia mangostana*), and selenium.

The energy boosting material can be administered in a single daily dose or multiple daily doses.

The dosage units can comprise from about 1 μg to about 10 g, alternatively from about 1 mg to about 5 g, and alternatively from about 100 mg to about 5 g of energy-boosting/enhancing material, per dosage unit.

The systems can provide from about 1 μg to about 10 g, alternatively from about 1 mg to about 5 g, and alternatively from about 100 mg to about 5 g of energy-boosting/enhancing material, per day.

The dosage units and systems can comprise a probiotic. Proboitcs can be useful in treating and/or preventing respiratory conditions, treating and/or preventing gastrointestinal conditions, as well as providing overall health benefits. As used herein, "probiotic" includes natural and/or genetically modified microorganisms, viable or dead; processed compositions of micro-organisms; their constituents and components such as proteins and carbohydrates or purified fractions of bacterial ferments; that beneficially affect a host. The general use of probiotics herein is in the form of viable cells. However, use can be extended to non-viable cells such as killed cultures or compositions containing beneficial factors expressed by the probiotic. Killed cultures may include thermally killed microorganisms, or microorganisms killed by exposure to altered pH or subjected to pressure. For the purpose of the present invention, "probiotic" is further intended to include metabolites generated by the microorganisms during fermentation, if they are not separately indicated. These metabolites may be released to the medium of fermentation, or they may be stored within the microorganism. As used herein "probiotic" also includes bacteria, bacterial homogenates, bacterial proteins, bacterial extracts, bacterial ferment supernatants, and mixtures thereof, which perform beneficial functions to a host animal when given at a therapeutically effective amount.

As used herein, the term "therapeutically effective amount" with reference to the probiotic described herein, means that amount of the probiotic sufficient to provide the desired effect or benefit to a host animal in need of treatment, yet low enough to avoid adverse effects such as toxicity, irritation, or allergic response, commensurate with a reasonable benefit/risk ratio when used in the manner of the present invention. The specific "therapeutically effective amount" will vary with such factors as the particular condition being treated, the physical condition of the host animal, the duration of the treatment, the nature of concurrent therapy (if any), the specific dosage form to be used, the carrier employed, the solubility of the dose form, and the particular dosing regimen.

The abbreviation "CFU" refers to "colony-forming unit" and as used herein designates the number of probiotic cells revealed by microbiological counts on agar plates, as will be commonly understood in the art.

Non-limiting examples of probiotic bacteria suitable for use herein include strains of *Streptococcus lactis, Streptococcus cremoris, Streptococcus diacetylactis, Streptococcus thermophilus, Lactobacillus bulgaricus, Lactobacillus acidophilus, Lactobacillus helveticus, Lactobacillus bifidus, Lactobacillus casei, Lactobacillus lactis, Lactobacillus plantarum, Lactobacillus rhamnosus, Lactobacillus delbruekii, Lactobacillus thermophilus, Lactobacillus fermentii, Lactobacillus salivarius, Lactobacillus reuteri, Lactobacillus brevis, Lactobacillus paracasei, Lactobacillus gasseri, Pediococcus cerevisiae, Bifidobacterium longum, Bifidobacterium infantis, Bifidobacterium adolescentis, Bifidobacterium bifidum, Bifidobacterium animalis, Bifidobacterium pseudolongum, Bifidobacterium thermophilum, Bifidobacterium lactis, Bifidobacterium bulgaricus, Bifidobacterium breve, Bifidobacterium subtilis, Escherichia coli* and strains of the genera including *Bacillus, Bacteroides, Enterococcus* (e.g., *Enterococcus faecium*) and *Leuconostoc*, and mixtures and/or combinations thereof.

Embodiments of the dosage units of the present invention comprise strains of lactic acid bacteria selected from the genera *Lactobacillus* and *Bifidobacterium*, such as *Lactobacilius acidophilus*, and *Bifidobacterium* lactis, and combinations and/or mixtures thereof.

In one embodiment, the dosage unit comprises a composition comprising a therapeutically effective amount of the *Lactobacillus*.

Non-limiting examples of *Lactobacillus* suitable for use herein include strains of *Lactobacillus bulgaricus, Lactobacillus acidophilus, Lactobacillus helveticus, Lactobacillus bifidus, Lactobacillus casei, Lactobacillus lactis, Lactobacillus plantarum, Lactobacillus rhamnosus, Lactobacillus delbruekii, Lactobacillus thermophilus, Lactobacillus fermentii, Lactobacillus salivarius, Lactobacillus reuteri, Lactobacillus brevis, Lactobacillus paracasei, Lactobacillus gasseri*, and combinations thereof.

The probiotic can be administered in a single daily dose or multiple daily doses.

The dosage units can comprise at least about $10^3$ CFU, alternatively from about $10^3$ to about $10^{14}$ CFU, alternatively from about $10^6$ to about $10^{12}$ CFU, and alternatively from about from about $10^8$ to about $10^{11}$ CFU of *Lactobacillus*, per dosage unit. The *Lactobacillus* may be administered in either viable form, or as killed cells, or distillates, isolates or other fractions of the fermentation products of the *Lactobacillus* used herein, or any mixture or combination thereof.

The systems can provide at least about $10^3$ CFU, alternatively from about $10^3$ to about $10^{14}$ CFU, alternatively from about $10^6$ to about $10^{12}$ CFU, and alternatively from about from about $10^8$ to about $10^{11}$ CFU of *Lactobacillus*, per day.

In one embodiment, the dosage units comprise a composition comprising a therapeutically effective amount a strain of *Bifidobacterium*, which can be mammalian. The mammal treated and a mammalian source of *Bifidobacterium* isolation may be, but need not be, independent.

Non-limiting examples of *Bifidobacterium* suitable for use herein include strains of *Bifidobacterium longum, Bifidobacterium infantis, Bifidobacterium adolescentis, Bifidobacterium bifidum, Bifidobacterium animalis, Bifidobacterium pseudolongum, Bifidobacterium thermophilum, Bifidobacterium lactis, Bifidobacterium bulgaricus, Bifidobacterium breve, Bifidobacterium subtilis,* and mixtures and/or combinations thereof.

In one embodiment herein, the dosage units can comprise at least about $10^3$ CFU, alternatively from about $10^3$ to about $10^{14}$ CFU, alternatively from about $10^6$ to about $10^{12}$ CFU, and alternatively from about from about $10^8$ to about $10^{11}$ CFU of *Bifidobacterium*, per dosage unit. The *Bifidobacterium* may be administered in either viable form, or as killed cells, or distillates, isolates or other fractions of the fermentation products of the *Bifidobacterium* used herein, or any mixture or combination thereof.

The systems can provide at least about $10^3$ CFU, alternatively from about $10^3$ to about $10^{14}$ CFU, alternatively from about $10^6$ to about $10^{12}$ CFU, and alternatively from about from about $10^8$ to about $10^{11}$ CFU of *Bifidobacterium*, per day.

As a portion of the compositions of the dosage units, the probiotic, as a freeze-dried powder (as would be understood by one of skill in the art) can comprise from about 1% to about 50%, alternatively from about 1% to about 40%, alternatively from about 1% to about 30%, and alternatively from about 2% to about 20%, by weight of the composition of the dosage unit.

The dosage units and systems can also comprise fiber. Fiber can be useful in treating and/or preventing gastrointestinal conditions, as well as providing overall gastrointestinal health benefits. As used herein, the term "fiber" means carbohydrate polymers including those naturally occurring in food as consumed; those having been obtained from food raw material by physical, enzymatic or chemical means; and synthetic carbohydrate polymers, which are resistant to digestion and absorption in the small intestine and have partial fermentation in the large intestine.

Non-limiting examples of fibers and analogous carbohydrate polymers include pectins, psyllium, guar gum, xanthan gum, alginaes, gum arabic, fructo-oligosaccharides, inulin, agar, beta-glucans, chitins, dextrins, lignin, celluloses, non-starch polysaccharides, carrageenan, reduced starch, and mixtures and/or combinations thereof.

In one embodiment, the fiber is glucose polymers, preferably those which have branched chains. Among such suitable fibers is one marketed under the tradename "Fibersol2", commercially available from Matsutani Chemical Industry Co., Itami City, Hyogo, Japan.

Other non-limiting examples of suitable fibers include oligosaccharides, such as inulin and its hydrolysis products commonly known as fructo-oligosaccharides, galacto-oligosaccharides, xylo-oligosaccharides, and oligo derivatives of starch.

The fiber can be provided in any suitable form. A non-limiting example is in the form of a plant material which contains the fiber. Non-limiting examples of suitable plant materials include asparagus, artichoke, onion, wheat, chicory, beet pulp, residues of these plant materials, and mixtures and/or combinations thereof.

A non-limiting example of a fiber from such a plant material is inulin extract from extract of chicory. Suitable inulin extracts can be obtained from Orafti SA of Belgium under the trademark Raftiline®. Alternatively the fiber can be in the form of a fructo-oligosaccharide which can be obtained from Orafti SA of Belgium under the trademark Raftilose®. Alternatively, an oliogo-saccharide can be obtained by hydrolyzing inulin, by enzymatic methods, or by using microorganisms as will be understood by those of skill in the art. Alternatively the fiber can be Inulin and/or de-sugared inulin available from Cargill Health & Food Technologies, Wayzata, Minn., USA, or from Cosucra SA, Warcoing, Belgium.

In another embodiment, the fiber can be psyllium, available, which can be obtained from The Procter & Gamble Company, Cincinnati, Ohio, under the trademark Metamucil®.

The fiber can be administered in a single daily dose or multiple daily doses.

The dosage units can comprise from about 10 mg to about 100 g, alternatively from about 50 mg to about 50 g, alternatively from about 100 mg to about 50 g, alternatively from about 500 mg to about 50 g, and alternatively from about 1 g to about 40 g of fiber, per dosage unit.

The systems can provide from about 10 mg to about 100 g, alternatively from about 50 mg to about 50 g, alternatively from about 100 mg to about 50 g, alternatively from about 500 mg to about 50 g, and alternatively from about 1 g to about 40 g of fiber, per day.

The dosage units and systems can comprise a prebiotic. Prebiotics can be useful in treating and/or preventing gastrointestinal conditions, as well as providing overall gastrointestinal health benefits.

As used herein, the term "prebiotic" includes substances or compounds that beneficially affect the host mammal by selectively promoting the growth and/or activity of one or more probiotic bacteria in the gastro-intestinal tract of the host animal, thus maintaining normal health or improving health of the host. Typically, prebiotics are carbohydrates, (such as oligosaccharides), but the term "prebiotic" as used herein does not preclude non-carbohydrates. Many forms of "fiber" exhibit some level of prebiotic effect. Thus, there is considerable overlap between substances that can be classified as "prebiotics" and those that can be classified as "fibers".

Non-limiting examples of prebiotics suitable for use in the compositions and methods include psyllium, fructo-oligosaccharides, inulin, oligofructose, galacto-oligosaccharides, isomalto-oligosaccharides, xylo-oligosaccharides, soy-oligosaccharides, gluco-oligosaccharides, mannan-oligosaccharides, arabinogalactan, arabinxylan, lactosucrose, gluconannan, lactulose, polydextrose, oligodextran, gentioligosaccharide, pectic oligosaccharide, xanthan gum, gum arabic, hemicellulose, resistant starch and its derivatives, reduced starch, and mixtures and/or combinations thereof.

The prebiotic can be administered in a single daily dose or multiple daily doses.

The dosage units can comprise from about 100 mg to about 100 g, alternatively from about 500 mg to about 50 g, and alternatively from about 1 g to about 40 g of prebiotic, per dosage unit.

The systems can provide from about 100 mg to about 100 g, alternatively from about 500 mg to about 50 g, and alternatively from about 1 g to about 40 g of prebiotic, per day.

The dosage units and systems can comprise at least one polyphenol. Polyphenols are known to have antioxidant activity and anti-inflammatory effects and can thus be useful in treating and/or preventing respiratory and gastrointestinal conditions, as well as providing overall health benefits. Non-limiting examples of sources of polyphenols useful in the present invention include tea extract, rosemary extract, rosemarinic acid, coffee extract, caffeic acid, turmeric extract, blueberry extract, grape extract, grape seed extract, soy extract, and mixtures and combinations thereof.

The dosage units can comprise from about 0.01% to about 90%, alternatively from about 0.1% to about 35%, alternatively from about 1% to about 15%, alternatively from about 1% to about 10%, and alternatively from about 3% to about 10% of the polyphenol, by weight of the composition of the dosage unit.

Non-limiting sources of tea extract include black tea, white tea, oolong tea, and/or green tea.

When tea extract is present, the dosage units can comprise from about 0.01% to about 90%, alternatively from about 0.1% to about 35%, alternatively from about 1% to about 15%, alternatively from about 1% to about 10%, and alternatively from about 3% to about 10% tea extract, by weight of the composition of the dosage unit.

When tea extract is green tea, the dosage units can comprise from about 0.01% to about 90%, alternatively from about 0.1% to about 35%, alternatively from about 1% to about 15%, alternatively from about 1% to about 10%, and alternatively from about 3% to about 10% green tea extract, by weight of the composition of the dosage unit.

Constituents of rosemary or rosemary extract are caffeic acid and its derivatives such as rosemarinic acid. These compounds have antioxidant activity and anti-inflammatory effects. Non-limiting sources of rosemary extract suitable for use in the present invention include rosemary.

The dosage units can comprise from about 0.01% to about 90%, alternatively from about 0.1% to about 35%, alternatively from about 1% to about 15%, alternatively from about 1% to about 10%, and alternatively from about 3% to about 10% rosemary extract, by weight of the composition of the dosage unit.

The dosage units can comprise from about 0.01% to about 90%, alternatively from about 0.1% to about 35%, alternatively from about 1% to about 15%, alternatively from about 1% to about 10%, and alternatively from about 3% to about 10% rosemarinic acid, by weight of the composition of the dosage unit.

The main constituent of coffee extract is caffeic acid and is, without being limited by theory, believed to display antioxidant activity.

The dosage units can comprise from about 0.01% to about 90%, alternatively from about 0.1% to about 35%, alternatively from about 1% to about 15%, alternatively from about 1% to about 10%, and alternatively from about 3% to about 10% coffee extract, by weight of the composition of the dosage unit.

When coffee extract is present, non-limiting sources of coffee extract include coffee bean, coffee, coffee berry, coffee fruits. When caffeic acid is present, non-limiting sources of caffeic acid suitable for use in the present invention include tea, berries, coffee bean, coffee, coffee berry, coffee fruits, rosemary extract, and/or grape seed extract.

The dosage units can comprise from about 0.01% to about 90%, alternatively from about 0.1% to about 35%, alternatively from about 1% to about 15%, alternatively from about 1% to about 10%, and alternatively from about 3% to about 10% caffeic acid, by weight of the composition of the dosage unit.

Turmeric is a spice which comprises a main active compound that is curcumin. Curcumin is a bioactive polyphenol plant pigment. Without being limited by theory, it is believed that curcumin has antioxidant activity. A non-limiting source of turmeric extract for use in the present invention is tumeric.

The dosage units can comprise from about 0.01% to about 90%, alternatively from about 0.1% to about 35%, alternatively from about 1% to about 15%, alternatively from about 1% to about 10%, and alternatively from about 3% to about 10% turmeric extract, by weight of the composition of the dosage unit.

The dosage units and systems can comprise blueberry extract. Blueberry extract is rich in anthocyanins which display antioxidant activity. A non-limiting source of blueberry extract is blueberry.

The dosage unit can comprise from about 0.01% to about 90%, alternatively from about 0.1% to about 35%, alternatively from about 1% to about 15%, alternatively from about 1% to about 10%, and alternatively from about 3% to about 10% blueberry extract, by weight of the composition of the dosage unit.

The dosage units and systems can comprise grape seed extract. Grape seed extract is rich in procyanidins which display antioxidant activity. Grape seed extract comprises about 38.5% procyanindins. A non-limiting source of grape seed extract is grape seed.

The dosage units can comprise from about 0.01% to about 90%, alternatively from about 0.1% to about 35%, alternatively from about 1% to about 15%, alternatively from about 1% to about 10%, and alternatively from about 3% to about 10% grape seed extract, by weight of the composition of the dosage unit.

The dosage units and systems can comprise grape extract. Grape extract is rich in resveratrol which displays antioxidant activity. A non-limiting source of grape extract is whole grapes.

The dosage units can comprise from about 0.01% to about 90%, alternatively from about 0.1% to about 35%, alternatively from about 1% to about 15%, alternatively from about 1% to about 10%, and alternatively from about 3% to about 10% grape extract, by weight of the composition of the dosage unit.

The dosage systems and units can comprise soy extract. Soy extract is rich in isoflavonoids, such as genistein and diadzein, which display divers properties beneficial to health. A non-limiting source of soy extract is soy.

The dosage units can comprise from about 0.01% to about 90%, alternatively from about 0.1% to about 35%, alternatively from about 1% to about 15%, alternatively from about 1% to about 10%, and alternatively from about 3% to about 10% soy extract, by weight of the composition of the dosage unit.

The dosage units and systems can also comprise actives particularly useful for animals, non-limiting examples of which include dogs, cats, cows, rabbits and horses. Such actives can treat and/or prevent respiratory and/or gastrointestinal conditions as well as generally maintain and improve the overall health of the animal. While the types of actives described above can be used with both humans and other mammals, such as companion animals, the dosage units and systems of the present invention can also include actives particularly useful with non-human animals. In addition, although the actives described in this section are particularly useful with non-human animals, many of the actives described in this section are also suitable for use with humans.

Non-limiting examples of such actives include polyphosphates such as sodium hexametaphosphate (SHMP), sodium pyrophosphate, sodium tripolyphosphate, zinc chloride, copper gluconate, stannous chloride, stannous fluoride, sodium fluoride, triclosan; glucosamine hydrochloride, chondroitin sulfate, green lipped mussel, blue lipped mussel, methyl sulfonyl methane (MSM); boron, boric acid, phytoestrogens, phytoandrogens, genistein, diadzein, L-carnitine, chromium picolinate, chromium tripicolinate, chromium nicotinate; glucose anti-metabolites which include 2-deoxy-D-glucose, 5-thio-D-glucose, 3-O-methylglucose, anhydrosugars including 1,5-anhydro-D-glucitol, 2,5-anhydro-D-glucitol, and 2,5-anhydro-D-mannitol, mannoheptulose, avocado extract comprising mannoheptulose; fiber; prebiotics including in particular fructooligosaccharides; acid/base modifiers, potassium citrate, potassium chloride, calcium carbonate, calcium chloride, sodium bisulfate; eucalyptus, lavender, peppermint, and combinations thereof.

The active can be administered in a single daily dose or multiple daily doses. The active can be incorporated into various types of dosage units, as described above. Non-limiting examples of dosage units that are particularly useful with animals are treats and biscuits.

The dosage units, i.e. each treat or biscuit, can comprise from about 0.0001 mg to about 10 g, alternatively from about 0.001 mg to about 10 g, alternatively from about 0.01 mg to about 10 mg, alternatively from about 1 mg to about 10 g, alternatively from about 10 mg to about 5 g, alternatively from about 30 mg to about 5 g, alternatively from about 30 mg to about 3 g, alternatively from about 300 mg to about 3 g, alternatively from about 300 mg to about 1.5 g of active, alternatively from about 30 mg to about 600 mg, and alternatively from about 30 mg to about 300 mg of active, per dosage unit.

The systems can provide from about 0.0001 mg to about 10 g, alternatively from about 0.001 mg to about 10 g, alternatively from about 0.01 mg to about 10 mg, alternatively from about 1 mg to about 10 g, alternatively from about 10 mg to about 5 g, alternatively from about 30 mg to about 5 g, alternatively from about 30 mg to about 3 g, alternatively from about 300 mg to about 3 g, alternatively from about 300 mg to about 1.5 g of active, alternatively from about 30 mg to about 600 mg, and alternatively from about 30 mg to about 300 mg of active, per day.

The dosage units and systems can also comprise optional materials, non-limiting examples of which include amino-acids, fatty acids, carotenoids, anti-oxidants, and combinations thereof. The optional materials can be administered in a single daily dose or multiple daily doses.

When protein is broken down by digestion the result is 22 known amino acids. Eight are essential (cannot be manufactured by the body) the rest are non-essential (i.e. can be manufactured by the body with proper nutrition).

When an amino acid is present, the amino acid is selected from the group consisting of 1-Tryptophan, Taurine, Histidine, Carnosine, Alanine, Cysteine, and mixtures and/or combinations thereof.

The dosage units can comprise at least about 0.05%, alternatively from about 0.05% to about 10%, and alternatively from about 0.2% to about 5% of an amino acid, by weight of the composition of the dosage unit.

The dosage units can comprise from about 250 mg to about 2500 mg, alternatively from about 300 mg to about 2000 mg, and alternatively from about 400 mg to about 1000 mg of an amino acid, per dosage unit.

The systems can provide from about 250 mg to about 2500 mg, alternatively from about 300 mg to about 2000 mg, and alternatively from about 400 mg to about 1000 mg of an amino acid, per day.

A "carotenoid" is a class of pigments occurring in the tissues of higher plants, algae, bacteria and fungi. When a carotenoid is present, the carotenoid is selected from the group consisting of lutein, astaxanthin, zeaxanthin, bixin, lycopene, beta-carotene and mixtures and/or combinations thereof.

The dosage units can comprise at least about 0.01%, alternatively from about 0.01% to about 20%, and alternatively from about 0.05% to about 10% carotenoid, by weight of the composition of the dosage unit.

The dosage units and systems can comprise an antioxidant in addition to the vitamins, plant-derived materials, elements, and carotenoids described above that have antioxidant properties. As used herein, an antioxidant is an enzyme or other organic molecule that can counteract the damaging effects of oxygen in tissues.

When an antioxidant is present, non-limiting examples of such antioxidants include tocopherols (Vitamin E, described above), Vitamin C (described above), Vitamin A (described above), plant-derived materials (described above), carotenoids (described above), selenium (described above), CoQ10, and mixtures and/or combinations thereof.

The dosage units and systems of the present invention can comprise coenzyme Q10 (CoQ10). The dosage units comprise at least about 0.01%, alternatively from about 0.01% to about 10%, and alternatively from about 0.2% to about 5% Coenzyme Q10, by weight of the composition of the dosage unit.

The dosage units can comprise from about 1 mg to about 400 mg, alternatively from about 2 mg to about 400 mg, and alternatively from about 3 mg to about 300 mg of Coenzyme Q10, per dosage unit.

The systems can provide from about 1 mg to about 400 mg, alternatively from about 2 mg to about 400 mg, and alternatively from about 3 mg to about 300 mg of Coenzyme Q10, per day.

The dosage units and systems can comprise a fatty acid. Long chain fatty acids play a key role in arachidonic acid metabolism which could be useful in the modulation of pain and inflammation. Currently, long chain fatty acids, such as omega-6 fatty acids are used for their antioxidant and immune health benefits.

Non-limiting examples of suitable long chain fatty acids include alpha-linoleic acid, gamma linolenic acid, linoleic acid, eicosapentanoic acid, and docosahexanoic acid. Fish oils are a suitable source of eicosapentanoic acids (EPA) and docosahexanoic acid (DHA).

The dosage units comprise from at least about 0.05%, alternatively at least about 0.1%, and alternatively at least about 0.15% DHA, by weight of the composition of the dosage unit.

The dosage units can comprise from at least about 0.05%, alternatively at least about 0.1%, and alternatively at least about 0.15% EPA, by weight of the composition of the dosage unit.

The dosage units can also comprise an excipient as would be understood by those of skill in the art with respect to production of various types of dosage units. Non-limiting examples of excipients include microcrystalline cellulose, dicalcium phosphate, stearic acid, magnesium stearate, corn starch, lactose, sodium crosscarmellose, sodium starch glycolate, polyvinylpyrollidone, gelatin, and combinations thereof.

The dosage units can comprise from about 1% to about 99%, alternatively from about 2% to about 70%, alternatively from about 3% to about 50%, alternatively from about 5% to about 30%, and alternatively from about 6% to about 25%, of the excipient, by weight of the composition of the dosage unit.

The dosage units can also comprise one or more of a wide range of optional ingredients and process aids as would be understood by those of skill in the art with respect to production of various dosage forms. Non-limiting examples of optional ingredients include plasticizers, colorants, flavorants, sweeteners, buffering agents, slip aids, carriers, pH adjusting agents, natural ingredients, stabilizers, biological additives such as enzymes (including proteases and lipases), chemical additives, coolants, chelants, denaturants, drug astringents, emulsifiers, external analgesics, fragrance compounds, humectants, opacifying agents (such as zinc oxide and titanium dioxide), anti-foaming agents (such as silicone), preservatives (such as butylated hydroxytoluene (BHT) and butylated hydroxyanisole (BHA), propyl gallate, benzalkonium chloride, EDTA, benzyl alcohol, potassium sorbate, parabens and mixtures thereof), reducing agents, solvents, hydrotropes, solublizing agents, suspending agents (non-surfactant), solvents, viscosity increasing agents (aqueous and non-aqueous), sequestrants, keratolytics, and the like, and mixtures and/or combinations thereof.

Generally, unless otherwise specified herein, the dosage units can comprise from about 0.001% to about 99%, alternatively from about 0.01% to about 80%, alternatively from about 0.01% to about 50%, and alternatively from about 0.01% to about 10%, of optional ingredient(s) by weight of the composition of the dosage unit.

The above-described blister cards and systems provide for intuitive dosing instructions that aid users in administering a number of unit doses over different time periods, such as daily. The blister cards may be sized to fit easily within one's pocket or handbag. If not all of the unit doses are consumed, the information provided by the blister cards can provide an indication to the user of when the left-over unit doses are to be consumed.

It is noted that terms like "preferably," "generally," "commonly," and "typically" are not utilized herein to limit the scope of the claimed embodiments or to imply that certain features are critical, essential, or even important to the structures or functions. Rather, these terms are merely intended to highlight alternative or additional features that may or may not be utilized in a particular embodiment.

For the purposes of describing and defining the various embodiments it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A portable daily blister card housing a unit dose, comprising:

a back side including regulatory information located thereon;

a front side opposite the back side, the front side including:

a face having an outer periphery and a total planar area bounded by the outer periphery;

one or more blisters extending outwardly at the face that contain at least three unit doses wherein each unit dose comprises one or more daytime cold and flu actives selected from the group consisting of decongestants, expectorants, antihistamines, anti-tussives, and combinations thereof and wherein each unit dose is the same, each of the one or more blisters including a shoulder contacting a cavity backing surface and a projected cavity area bounded by the shoulder that is projected onto the cavity backing surface, the at least three unit doses being visible from outside the one or more blisters; and dosing instructions;

a primary manufacturer indicia area without blisters comprising a manufacturer indicator visible on the front side wherein the primary manufacturer indicia area extends continuously along the width between a right side edge and a left side edge;

wherein a total projected cavity area of the one or more blisters is no more than 45 percent of the total planar area bounded by the outer periphery;

wherein the blister card contains from 12 hours to 24 hours of unit doses according to the dosing instructions.

2. The daily blister card of claim 1, wherein the total projected cavity area includes only that area within 100 and 250 percent of a total projected dose footprint area provided by each of the at least three unit doses, where the total projected unit dose footprint area is the sum of each projected unit dose footprint area of the at least three unit doses onto the cavity backing surface.

3. The daily blister card of claim 1, wherein the total projected cavity area includes only that area within 100 and 150 percent of a total projected dose footprint area provided by each of the at least three unit doses.

4. The daily blister card of claim 1, wherein the outer periphery is rectangular in shape and the total projected cavity area of the one or more blisters is no more than 25 percent of the total planar area bounded by the outer periphery.

5. The daily blister card of claim 4, wherein the total planar area bounded by the outer periphery is no greater than 125 $cm^2$.

6. The daily blister card of claim 1 wherein the regulatory information comprises dosing instructions, lot number, expiration date, and opening instructions.

7. A kit comprising:

a portable blister card comprising a back side;

a front side opposite the back side, the front side including:

a face having an outer periphery and a total planar area bounded by the outer periphery;

one or more blisters extending outwardly at the face that contain at least three unit doses, each of the one or more blisters including a shoulder contacting a cavity backing surface and a projected cavity area bounded by the shoulder that is projected onto the cavity backing surface, the at least three unit doses being visible from outside the one or more blisters; and dosing instructions;

a primary manufacturer indicia area without blisters comprising a manufacturer indicator visible on the front side wherein the primary manufacturer indicia area extends continuously along the width between a right side edge and a left side edge;

wherein a total projected cavity area of the one or more blisters is no more than 45 percent of the total planar area bounded by the outer periphery;

wherein the blister card contains from 12 hours to 24 hours of unit doses according to the dosing instructions; and a second item comprising a second active ingredient.

8. The kit of claim 7 wherein the blister card comprises a daytime multi symptom relief cold and flu active and wherein the second item comprises a liquid comprising a nighttime multi symptom relief cold and flu active.

9. The kit of claim 7 wherein the blister card comprises a daytime multi symptom relief cold and flu active and wherein the second item comprises a second blister card comprising a nighttime multi symptom relief cold and flu active.

10. The kit of claim 7 wherein the blister card comprises three blisters wherein each blister contains one unit dose and the unit doses contain the same actives.

11. The kit of claim 7 wherein the unit doses are arranged in a sequentially directional dosing arrangement on the face.

12. The kit of claim 11, wherein the sequentially directional dosing arrangement is a left-to-right arrangement where unit doses on the left are to be consumed before unit doses on the right.

13. The kit of claim 7 wherein the regulatory information comprises dosing instructions, lot number, expiration date, and opening instructions.

* * * * *